US008985884B2

(12) United States Patent
Nakamura et al.

(10) Patent No.: US 8,985,884 B2
(45) Date of Patent: Mar. 24, 2015

(54) PEN DISPENSERS WITH CARTRIDGES AND INTERCHANGEABLE TIP APPLICATORS

(71) Applicant: Sashay Beauty Products, Inc., Moraga, CA (US)

(72) Inventors: Dennis Nakamura, Moraga, CA (US); Gary Rude, Hayward, CA (US)

(73) Assignee: Sashay Beauty Products, Inc., Moraga, CA (US)

( * ) Notice: Subject to any disclaimer, the term of this patent is extended or adjusted under 35 U.S.C. 154(b) by 0 days.

(21) Appl. No.: 13/954,773

(22) Filed: Jul. 30, 2013

(65) Prior Publication Data

US 2014/0030004 A1 Jan. 30, 2014

Related U.S. Application Data

(60) Provisional application No. 61/677,441, filed on Jul. 30, 2012.

(51) Int. Cl.

| | |
|---|---|
| ***B43K 5/10*** | (2006.01) |
| ***B05C 11/00*** | (2006.01) |
| ***B05C 17/005*** | (2006.01) |
| ***B05C 17/01*** | (2006.01) |

(52) U.S. Cl.

CPC ..... *B05C 11/00* (2013.01); *B05C 17/00516* (2013.01); *B05C 17/0052* (2013.01); *B05C 17/012* (2013.01); *B05C 17/00596* (2013.01)

USPC ..... 401/176; 401/171; 401/179

(58) Field of Classification Search

CPC ..... A61C 5/064; B05C 11/00

USPC ..... 401/171, 176, 179, 180, 277, 278, 279

See application file for complete search history.

(56) References Cited

U.S. PATENT DOCUMENTS

| | | | |
|---|---|---|---|
| 4,077,550 | A | 3/1978 | Van Manen |
| 4,599,008 | A | 7/1986 | Furlong |
| 4,599,088 | A | 7/1986 | Davis et al. |
| 4,688,808 | A | 8/1987 | Iijima |
| 4,854,760 | A | 8/1989 | Pike |
| 5,279,586 | A | 1/1994 | Balkwill |
| 5,372,444 | A | 12/1994 | Lhuisset |
| 5,433,352 | A | 7/1995 | Ronvig |
| 5,460,242 | A | 10/1995 | Graf |
| 5,535,924 | A | 7/1996 | Nilsson |
| 5,573,147 | A | 11/1996 | Nilsson |
| 5,879,633 | A | 3/1999 | Tervamaki |

(Continued)

FOREIGN PATENT DOCUMENTS

| | | | |
|---|---|---|---|
| DE | 19504057 | C1 | 1/1996 |
| WO | WO 00/78176 | A2 | 12/2000 |
| WO | WO 01/76408 | A1 | 10/2001 |

OTHER PUBLICATIONS

International search report and written opinion dated Jan. 14, 2014 for PCT Application No. US2013/052762.

*Primary Examiner* — David Walczak
*Assistant Examiner* — Jennifer C Chiang
(74) *Attorney, Agent, or Firm* — Wilson Sonsini Goodrich & Rosati

(57) ABSTRACT

A pen dispenser for dispensing flowable and non-flowable material, comprising a pen body and an optional push button applicator for the pen, a universal cartridge, optionally having a disposable cartridge, and capable of accepting a multitude of interchangeable tip applicators.

20 Claims, 26 Drawing Sheets

(56) References Cited

U.S. PATENT DOCUMENTS

| | | | | |
|---|---|---|---|---|
| 5,937,864 | A | 8/1999 | Diaz | |
| 6,283,660 | B1 * | 9/2001 | Furlong et al. | 401/135 |
| 6,530,709 | B1 | 3/2003 | Washington | |
| 6,902,339 | B2 * | 6/2005 | King | 401/270 |
| 6,905,276 | B2 | 6/2005 | Van Buskirk | |
| 7,044,673 | B2 | 5/2006 | Endou | |
| 7,144,177 | B2 | 12/2006 | Van Buskirk | |
| 7,258,119 | B2 | 8/2007 | Mazzoni | |
| 7,296,945 | B1 * | 11/2007 | Byun | 401/286 |
| 7,427,170 | B2 | 9/2008 | Van Buskirk | |
| 7,841,794 | B2 | 11/2010 | Salciarini | |
| 8,075,215 | B2 | 12/2011 | Albisetti | |
| 8,360,670 | B2 | 1/2013 | Zahn | |
| 8,540,124 | B2 | 9/2013 | Francavilla | |
| 2007/0142789 | A1 * | 6/2007 | Fisher et al. | 604/207 |
| 2009/0060624 | A1 * | 3/2009 | Schenck et al. | 401/171 |
| 2012/0289907 | A1 | 11/2012 | Veasey | |

* cited by examiner

PEN DISPENSERS WITH CARTRIDGES AND INTERCHANGEABLE TIP APPLICATORS

CROSS-REFERENCE

This application claims the benefit of U.S. Provisional Application No. 61/677,441, filed Jul. 30, 2012, which application is incorporated herein by reference.

BACKGROUND OF THE INVENTION

Pen dispensers provide one means to dispense a variety of products, including but not limited to lubricants, glues, medications and cosmetics. Applicators come in a variety of shapes and sizes, with many being disposable. A requisite for reusable pen dispensers, particularly those produced in mass quantity for general consumption is that they are simple and economical to manufacture and use. A requisite for the fluids used therein is that they be sealed within a container sufficient to prevent them breaking down, evaporating or drying out. A requisite for a disposable container is that it be simple to use, and economical to manufacture.

SUMMARY OF THE INVENTION

Provided herein is a pen dispenser for dispensing material comprising a cartridge system with interchangeable tip applicators, a pen body comprising; a posterior jacket, a ratchet rod compression spring, a ratchet rod, a button carriage, an anterior jacket, an activator button, and a barrel key, wherein said posterior jacket internally accepts said ratchet rod compression spring, and said ratchet rod compresses said ratchet rod compression spring, and wherein said button carriage slides over, and captures said distal end of said ratchet rod, compressively retaining said ratchet rod compression spring, and said barrel key slides over said protruding ratchet rod wherein distal detents on said barrel key engage a capturing groove in said anterior surface of said button carriage, and said anterior jacket, aligns with, slides over, and simultaneously captures said barrel key, said button carriage, and outer diametral capture features of said posterior jacket, forming an assembled button housing, wherein said activator button inserts, and is captured within said button carriage, and said assembled button housing, and wherein said activator button aligns with a non-splined side of said ratchet rod within said pen body and said barrel key is accessible through an anterior opening in said anterior jacket. In some embodiments of the pen dispenser said ratchet rod is rectangular shaped and has splined teeth on one surface. In some embodiments of the pen dispenser said barrel key is a hollow tubular structure comprising an open proximal end with a connection mechanism for receiving interchangeable components through said anterior opening of said anterior jacket, and a closed distal end having a rectangular shaped opening therethrough for receiving said protruding ratchet rod at a fixed rotation wherein said splined side of said ratchet rod can enter said shaped opening in only one orientation. In some embodiments of the pen dispenser said interchangeable components comprise; cartridges comprising flowable material and interchangeable tip applicators. In some embodiments of the pen dispenser said interchangeable components comprise; interchangeable tip applicators and tip adapters for applying non flowable materials. In some embodiments of the pen dispenser said interchangeable components comprise; temporary caps.

Provided herein is a pen dispenser for dispensing flowable material comprising: a pen body comprising; a posterior jacket having a proximal button housing, a ratchet rod compression spring, a ratchet rod having splined teeth on opposing sides and non-splined sides 90° to each splined side, a button carriage, an anterior jacket having a proximal button housing, an activator button, a barrel key capable of holding a cartridge within the anterior jacket housing, and an optional protective cap, wherein said posterior jacket having said proximal button housing internally accepts said ratchet rod compression spring, and said ratchet rod compresses said ratchet rod compression spring, and wherein said button carriage slides over, and captures the posterior end of the ratchet rod, compressively retaining the ratchet rod compression spring, aligning with, and engaging internal capture features of the posterior jacket, and said barrel key slides over the protruding ratchet rod wherein distal detents on said barrel key engage a capturing groove in the anterior surface of said button carriage, and said anterior jacket having said proximal button housing, aligns with, slides over, and simultaneously captures said barrel key, the button carriage, and outer diametral capture features of the posterior jacket having said proximal button housing, forming an assembled button housing, wherein said activator button inserts, and is captured within said button carriage, and said assembled button housing, and wherein the activator button aligns with a non-splined side of the ratchet rod within the pen body. In some embodiments of the pen dispenser, the barrel key is capable of accepting a multitude of interchangeable components comprising; universal cartridges, filled with flowable material and capable of accepting a multitude of interchangeable tip adapter assemblies, tip adapters, a special tip attachment or holder capable of accepting at least one interchangeable tip applicator, and alternately accepting a temporary cap with a decorative jewel. In some embodiments, the universal cartridge comprises; a tubular body having a proximal and distal end, a hollow interior cylinder with a distal opening for receiving flowable material, an exterior cylinder with a distal portion, a threaded proximal portion and a winged cap portion proximal to the threaded portion, a proximal opening having a connection mechanism for receiving one of the interchangeable tip adapter assemblies, tip adapters, a special tip attachment or holder capable of accepting an interchangeable tip, a separable piston, positionable in the distal interior opening of the cylinder for sealing said flowable materials therein and for providing a compression ram surface to dispense said flowable material, and a seal positionable over the distal end of the cartridge. In some embodiments, a tip adapter comprises; a tubular body having a proximal and distal end, a hollow interior cylinder with a distal opening, an exterior cylinder with a distal portion, a threaded proximal portion and a winged cap portion proximal to the threaded portion wherein said distal portion comprises a base having a connection mechanism for insertion into the proximal end of said cartridge, a proximal opening having a connection mechanism for receiving an interchangeable tip applicators or special tip adapters capable of accepting an interchangeable tip applicator. In some embodiments, the interchangeable tip applicator assembly comprises; a tip adapter and an interchangeable special tip attachment or holder capable of accepting an interchangeable special tip applicator. In some embodiments, the connection mechanisms comprise; a taper connection, a press-fit connection, a compression fitting connection, a threaded connection, a bayoneted connection, or a snap-fit connection. In some embodiments of the pen dispenser, the barrel key is a hollow tubular structure with an open proximal end capable of accepting the cartridge or tip adapter, and a closed distal end having a shaped opening therethrough for receiving the ratchet rod at a fixed rotation, away from the engagement angle necessary to contact the activator button.

In some embodiments, the proximal body of the barrel key comprises internal threads for receiving and capturing the threaded external body of the cartridge or tip adapter. In some embodiments, the cartridge is fully engaged in the barrel key, and the barrel key is twisted in a clockwise rotation, causing the ratchet rod to simultaneously and synchronously rotate until the splined teeth on the one side of the ratchet rod engage with the activator button. In some embodiments, the ratchet rod advances anteriorly due to the posteriorly placed, low value k force compression spring, under the compressive load of each push on the activator button. In some embodiments, the ratchet rod will anteriorly advance the distance of one or more splined teeth at a time. In some embodiments, the anterior end of the ratchet rod penetrates the seal of the cartridge and compresses the piston and dispenses the flowable material contained therein out of the cartridge and through the attached tip applicator. In some embodiments, the interchangeable tip adapter comprises; a base having a connection mechanism for insertion into the proximal end of a cartridge or tip adapter, a fluid channel, through-hole, or outlet means in fluid communication with the proximal end of the dispensing tip outlet and the distal end of the interchangeable tip applicator connection mechanism, and an optional external thread for receiving a protective cap. In some embodiments, the alternate tip applicator assembly comprises; a base having a connection mechanism for insertion into the proximal end of a cartridge, a longitudinal through-hole in fluid communication with the proximal end of the dispensing tip outlet and the distal end of the interchangeable tip applicator connection mechanism, wherein said interchangeable tip applicator is capable of receiving a tip holder for other interchangeable brush tips, insertable in the through-hole therein. In some embodiments, the tip holder comprises; a base having a distal cylindrical extension with a connection mechanism for insertion into the proximal end of the interchangeable tip applicator, a proximal extension with a sized hole therein for receiving other interchangeable brush tips, a fluid channel or through-hole, longitudinally therethrough, and is in fluid communication with the end of the distal extension of the tip holder. In some embodiments, the tip holder is capable of receiving other interchangeable tip applicators comprising; a mascara brush, a fine bristle brush, a broad bristle brush, a foundation brush, a fine comb, a mustache comb, and an eyebrow brush. In some embodiments, the connection mechanism between the cartridge, the interchangeable tip applicator, tip adapter or special tip adapter comprises; a press-fit connection, a compression fitting, a tapered fitting, a threaded connection, a bayoneted connection, or a snap fitting. In some embodiments, the interchangeable tip applicator comprises; a felt tip, a foam tip, a cotton tip, a spray tip applicator, a shaped polymer tip applicator, a captured roller ball, a hair color dye comb, or a mustache brush. In some embodiments, the sealing cap for the universal cartridge or interchangeable tip applicator assembly comprises; a proximally close-ended cylinder with an open distal end sized to fit snugly over the proximal end of said cartridges and covering any one of said interchangeable tip applicators. In other embodiments, the protective sealing cap optionally comprises side wall slots to align with the proximal winged cap of the cartridge. In still other embodiments, the protective sealing cap optionally comprises an internal fluid channel spike to seal a through-hole of a tip applicator. And in still other embodiments, the protective sealing cap optionally comprises a threaded distal connection for attachment to a mating threaded connection on an interchangeable tip applicator assembly or tip adapter. Additionally, any one of the protective sealing caps optionally comprises a sealing ring to create an air-tight chamber within the cap when applied to said cartridges or tip applicator assemblies. In some embodiments, the flowable material comprises nail polish, paint, ink, gel, hydrogel, lip gloss, varnish, solvents, hair color dye, perfume, cologne, paste, cosmetics, fingernail or cosmetic glues, lubricants, nutraceuticals, moisturizers and medicaments. In some embodiments, the flowable materials contain solvents to prevent said materials from curing prematurely or when exposed to air for brief periods. In some embodiments, the flowable materials do not contain solvents to prevent said materials from curing prematurely or when exposed to air for brief periods. In some embodiments of the pen dispenser, the ratchet rod advances with each press of the activator button, penetrating the distal seal of the universal cartridge, applying pressure to the piston, and pushes the flowable material from said cartridge into the through-hole, exit hole, fluid channel or outlet means of the attached interchangeable tip applicator or tip adapter. In some embodiments, the pen dispenser barrel key is twisted in a counter-clockwise rotation, causing the ratchet rod to synchronously de-rotate until the splined teeth on the one side of the ratchet rod disengage from the activator button. In some embodiments, the pen dispenser activator button comprises an integral v-shaped leaf spring for engaging the splined teeth of the ratchet rod. In some embodiments of the device, each cartridge is intended for 1-time use. In some embodiments of the device, each cartridge is intended for multiple uses. In some embodiments of the device, the alternate tip adapter is intended for 1-time use. In some embodiments of the device, the alternate tip adapter is intended for multiple uses.

Provided herein is a cartridge system comprising a capsular containment cartridge body further comprising an open proximal end and open distal end, wherein, said proximal end comprises a connection mechanism for interchangeable tip applicators, and said distal end comprising a ram piston and seal, wherein said capsular body contains a flowable material, and wherein said capsular body inserts into a pen dispenser, wherein a ratchet rod in said pen dispenser is arranged to push through said seal, contacting said ram piston. In some embodiments, the cartridge system connection mechanism for interchangeable tip applicators comprises a tapered connection or a compression fitting. In some embodiments, the cartridge system connection mechanism for interchangeable tip applicators alternately comprises a press-fit connection. In some embodiments of the cartridge system said interchangeable tip applicators comprise a tip holder and an applicator tip. In some embodiments, of the cartridge system said flowable material comprises cosmetic materials comprising nail polish, hair dye color, lip gloss, perfume, cologne, fingernail glue, cosmetic glue, hydrogel nail paint, and nail varnish. In some embodiments, the tip holder comprises a tubular body comprising a proximal and distal end, a hollow interior cylinder with a distal opening, an exterior cylinder with a distal press-fit connection mechanism for insertion into said proximal end of said capsular containment cartridges, a threaded exterior proximal portion for receiving a threaded tip holder protective cap. In some embodiments, the applicator tip comprises a fine bristle brush, a felt tip, a foam tip, a cotton tip, a spray tip applicator, a shaped polymer tip applicator, a captured roller ball, a hair dye comb, or a mustache brush. In some embodiments, the applicator tip comprises a spike for receiving alternate applicator tips. In some embodiments, the alternate applicator tip comprises a spike for receiving alternate applicator tips or a fine bristle brush. In some embodiments of the cartridge system said capsular containment cartridge body further comprises a threaded proximal exterior portion and a winged portion proximal to said threaded portion. In some embodiments of the cartridge system, a cartridge system slotted protective cap mates with said winged proximal portion of said capsular containment cartridge body to protect said interchangeable tip applicators. In some embodiments the cartridge holder protective cap comprises a proximally close-ended cylinder with an open distal end sized to fit snugly over said winged proximal portion of said cartridges and covering said interchangeable tip applicators. In some embodiments the tip holder threaded protective cap comprises a proximally close-ended cylinder with an open distal end comprising internal threads sized to match said external threads of said tip holder and a hollow interior to cover said applicator tips. In some embodiments the tip holder threaded protective cap further comprises an internal fluid channel spike to seal a through-hole of an applicator tip. In still other embodiments, the tip holder threaded protective cap comprises an internal sealing ring to create an air-tight chamber within said tip holder threaded protective cap when applied to said tip holder.

Provided herein is a pen dispenser for dispensing non-flowable material comprising; a pen body comprising; a posterior jacket having a proximal button housing, a button carriage, a activator button, an anterior jacket having an proximal button housing, and a barrel key, capable of holding an alternate tip adapter within the anterior jacket housing, and an optional protective sealing cap, wherein said posterior jacket having said proximal button housing internally accepts and mates with said button carriage, and barrel key distal detents on said barrel key engage a capturing groove in the anterior surface of said button carriage, and said anterior jacket having said proximal button housing, aligns with, slides over, and simultaneously captures said barrel key, the button carriage, and outer diametral capture features of the posterior jacket, forming an assembled button housing, wherein said activator button inserts, and is captured within said button carriage, and said assembled button housing, and wherein an interchangeable tip applicator assembly for non-flowable material is inserted though the anterior opening of the anterior jacket and into the barrel key. In some embodiments, the interchangeable tip applicator assembly for non-flowable material comprises; a tubular body having a proximal and distal end, a hollow interior cylinder with a distal opening, an exterior cylinder with a distal portion, a threaded proximal portion and a winged cap portion proximal to the threaded portion wherein the distal portion comprises a base having a connection mechanism for insertion into the proximal end of the tip adapter, a proximal opening having a connection mechanism for receiving at least one interchangeable tip applicator or tip attachment. In some embodiments, the interchangeable tip applicator comprises; a base having a connection mechanism for insertion into the proximal end of said interchangeable tip applicator assembly for non-flowable material, an optional through-hole, or outlet means therethrough, in fluid communication with the proximal end of the dispensing tip outlet and the distal end of the interchangeable tip applicator connection mechanism, and an optional external thread for receiving a protective cap. In some embodiments, the interchangeable tip holder alternately comprises; a base having a connection mechanism for insertion into the proximal end of said interchangeable tip holder assembly for non-flowable material, a longitudinal through-hole in fluid communication with the proximal end of the dispensing tip outlet and the distal end of the tip applicator connection mechanism, wherein said tip holder is capable of receiving a tip applicator other interchangeable tips, such as fine brush tips, insertable in the through-hole therein. In some embodiments a tip holder comprises; an interchangeable tip applicator for either flowable or non-flowable material comprising a proximal exterior cylinder with a rounded proximal tip, an optional threaded exterior distal to said proximal tip for receiving a protective cap, an abutting shoulder distal to the rounded proximal tip and optional threads, and a smooth distal exterior cylinder portion. In some embodiments, the tip holder comprises; a cylindrical body having a distal connection mechanism, which may optionally be a thread or press-fit connection, a shoulder stop, a proximal cylindrical body and countersink hole with an optional through-hole therein, for receiving interchangeable tip applicators for either flowable or non-flowable material, such as interchangeable fine brush tips. In some embodiments, the interchangeable tip applicators for non-flowable material or tip adapters comprise a base having a connection mechanism for insertion into the proximal end of the tip applicator assembly for non-flowable material. In some embodiments of the interchangeable tip applicators for non-flowable material or tip adapters, the connection mechanism comprises a press-fit connection, a tapered fitting, a compression fitting, a bayonet connection, a threaded connection, or snap fitting. In some embodiments of the interchangeable tip applicator assembly, the externally distal threaded portion threads directly into said barrel key. In some embodiments of the device, the interchangeable tip applicator assemblies for non-flowable material comprise; any one of a multitude of available interchangeable tip applicators for non-flowable material comprising; a felt tip, a foam tip, a cotton tip, an eyelash brush, a fine comb, a mustache comb, a hair comb, a mascara brush, a fine bristle brush, a broad make-up brush, and a foundation brush. In some embodiments of the device, the non-flowable materials are cosmetics comprise; mascara, foundation, powder makeup materials, viscous glues and creams.

Provided herein is a cartridge system comprising; at least one interchangeable tip applicator having an outlet means, an optionally disposable capsular containment cartridge body having a proximal end and a distal end, wherein, said proximal end comprises a connection mechanism for an interchangeable tip applicator; said distal end comprising a rain piston and plastic, polymer or other suitable seal, the capsular unit of the cartridge body containing a flowable material; wherein the disposable capsular unit inserts into a pen dispenser wherein a ratchet rod pushes through the seal, contacting the ram piston. In some embodiments, of the cartridge system, the ram piston is pushed into the disposable capsular containment cartridge body forcing said flowable material through the dispensing tip outlet means of the attached interchangeable tip applicator. In some embodiments, the cartridge system interchangeable tip applicator contains a central through-hole, an exit hole, multiple holes, a fluid channel, or other outlet means having fluid communication with the proximal dispensing tip and the interior of the disposable containment cartridge whereby the substance being dispensed flows out of the capsule of the cartridge and through the tip applicator outlet means. In some embodiments, the at least one interchangeable tip applicator comprises; a connection mechanism adaptable for insertion into the proximal end of a disposable capsular unit of the cartridge, having a through-hole or outlet means in fluid communication with the dispensing tip outlet means and said disposable capsular unit, and any one of a multitude of interchangeable tip applicators comprising; a fine comb, a mustache comb, an eyebrow brush, an eyelash brush, a hair comb, a mascara brush, a fine bristle brush, a felt tip, a cotton tip, a foam tip, a sprayer tip applicator, a shaped polymer tip applicator, a paint brush, or a captured roller ball. Provided herein is an interchangeable tip applicator for dispensing non-flowable material comprising a tip adapter comprising a tubular body comprising a proximal and distal end, a hollow interior cylinder with a distal opening, and a proximal opening having a connection mechanism to receive an applicator tip, an exterior cylinder comprising a distal threaded connection for insertion into a pen dispenser, and an applicator tip comprising a connection mechanism to mate with said tip adapter. In some embodiments of the interchangeable tip applicator said connection mechanism for an applicator tip comprises a press-fit connection. In some embodiments of the interchangeable tip applicator said non-flowable material is acquired and applied to said applicator tip from another container. In some embodiments, the non-flowable material comprises cosmetic foundation. In some embodiments the non-flowable material comprises mascara. In some embodiments the applicator tip comprises a foundation brush, an eyebrow brush, an eyelash brush, a hair comb, or a mascara brush. In some embodiments the applicator tip further comprises a fine comb, a mustache comb, a fine bristle brush, a felt tip, a cotton tip, a shaped polymer tip applicator, a paint brush, or a sponge tip.

Method of Use

Provided herein is a method of using a pen dispenser wherein flowable material is applied from a cartridge filled with the flowable material to be dispensed, and capable of accepting a multitude of interchangeable tip applicators. In some embodiments of the method of using the pen dispenser, the device may be used in a manual mode wherein non-flowable material is applied with tip applicators for non-flowable material adapted for insertion into tip applicators assemblies for non-flowable materials, optionally having tip adapters for still other, non-standard tip applicators. In the manual mode, the ratchet rod and compression spring are not engaged and have no function. In some embodiments of this device, the inventors have provided a method of using a cartridge system, wherein the cartridges may be designated for 1-time use or multiple uses. In some embodiments of this device, the inventors have provided a method of using a manual tip applicator assembly system, wherein the tip applicator assemblies or individual tip adapters may be designated for 1-time use or multiple uses.

Method of Manufacture

Provided herein is a method of manufacturing a pen dispenser, wherein components are toleranced for rapid manual assembly. In some embodiments, components are toleranced for rapid automated assembly. In some embodiments, moving components are minimized or eliminated to simplify use. In some embodiments, components with similar function are easily interchangeable during assembly and use. In some embodiments, connection mechanisms are of the same configuration for all interchangeable components. In some embodiments, components having similar function have similar connection mechanisms. In some embodiments, different component groups have different connection mechanisms to prevent incorrect assembly.

Composition—(Flowable Materials)

In some embodiments, the composition of flowable material is a cosmetic. In some embodiments, the composition of flowable material comprises; a medicament, a nail polish a lip gloss, a paint, a hair color dye, a cosmetic or fingernail glue, a lubricant, a solvent, an ink, a gel, a hydrogel, a varnish, a perfume, a cologne a paste, a nutraceutical, or a moisturizer.

Composition—(Non-Flowable Material):

Provided herein is a composition of non-flowable materials for use in a pen dispenser, wherein the material is a cosmetic powder. In some embodiments, the composition of non-flowable materials comprises, mascara, a concealer, a foundation, a powder, a medicament, or a viscous paste.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
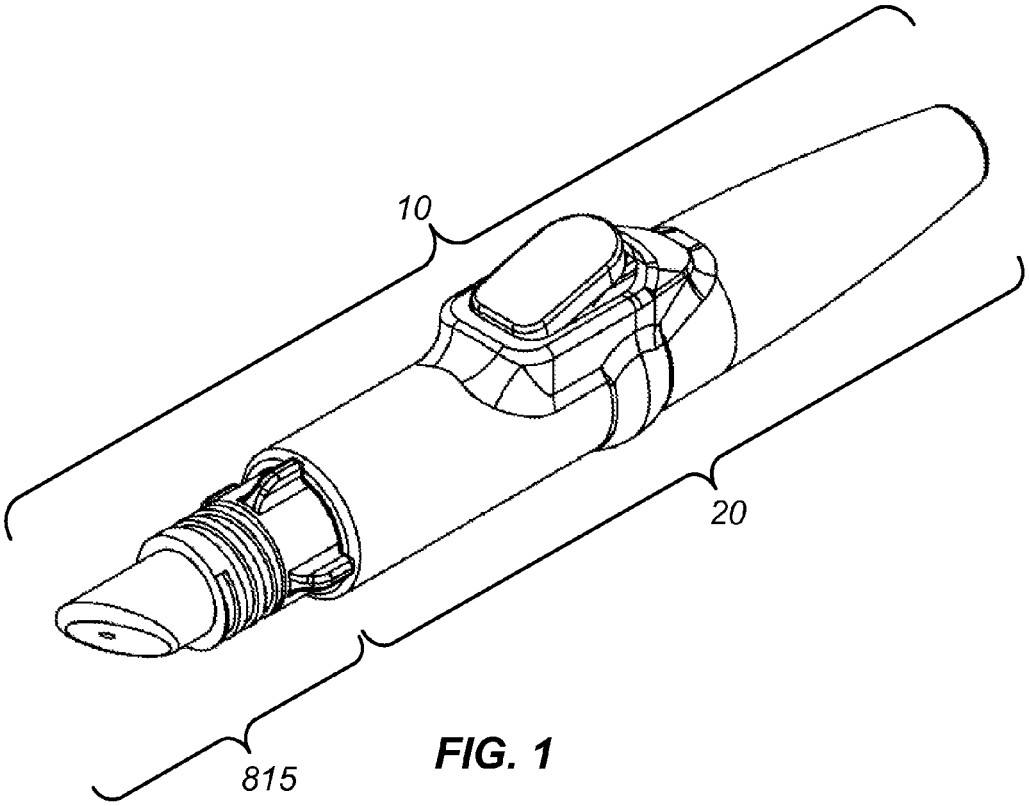
FIGS. 1 and 2 are isometric views of preferred embodiments of the device assembly.

Provided herein is a pen dispenser 10 for dispensing flowable material. As illustrated in FIGS. 1-4 several preferred embodiments demonstrate the versatility of construction offered to the user. Additionally, as shown in FIG. 1, a universal cartridge with one tip applicator assembly 815, could easily be substituted with another tip applicator assembly for a different application. As will become apparent to the reader, the design provides a multitude of options and flexibility not previously provided by the manufacturer or made available to the end-user, as will be illustrated herein. Additionally, due to the tolerancing, component selection, and interchangeability of components, manufacturing and assembly options are greatly increased.

Figure 2:
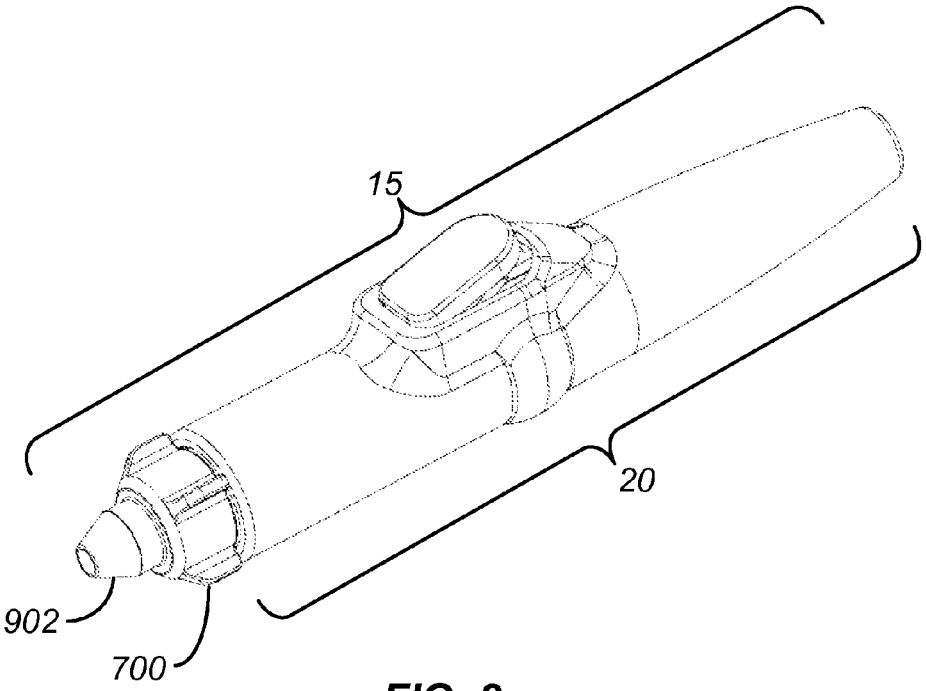
Figure 3:
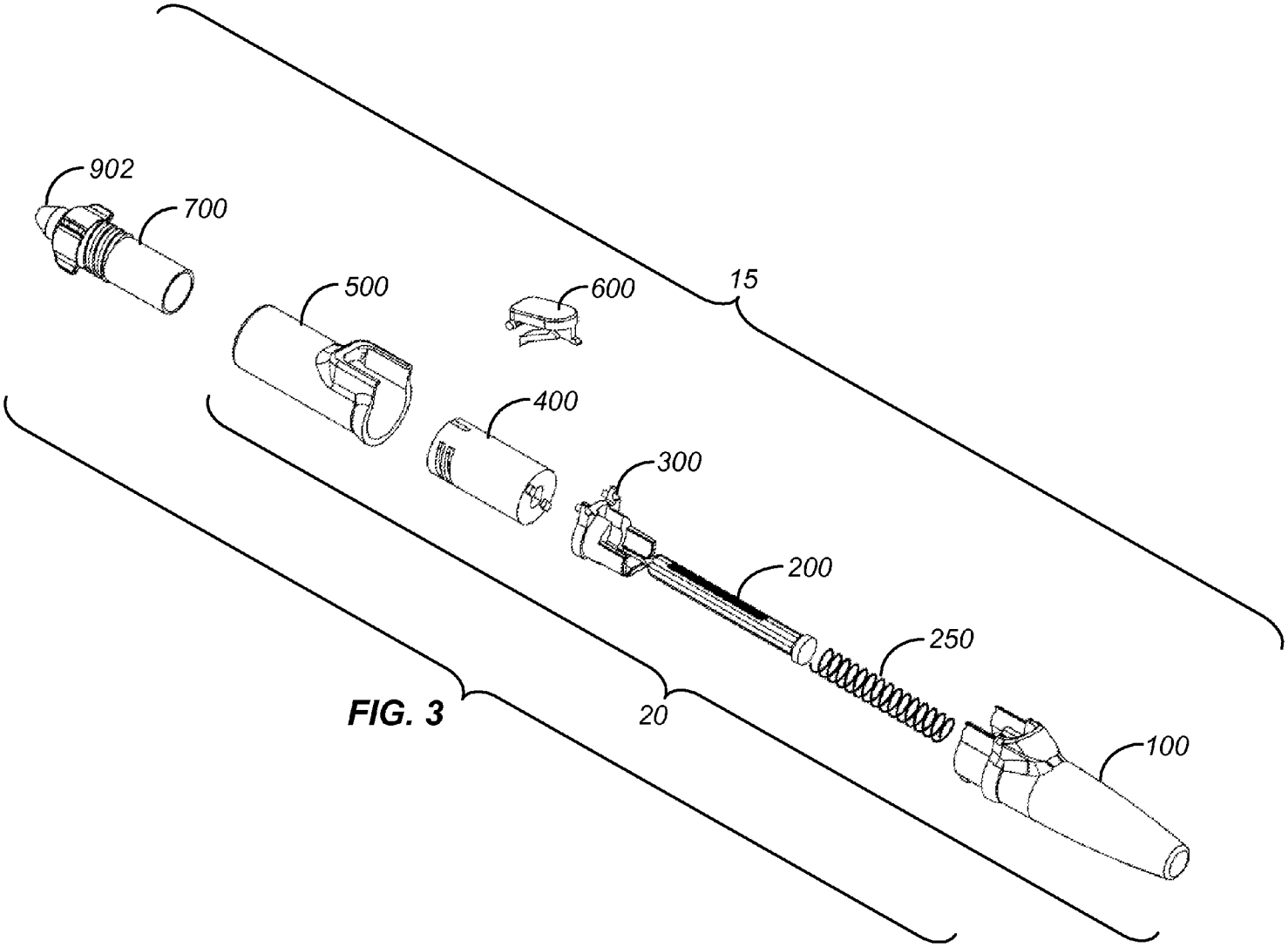
FIG. 3 is an isometric exploded view of a preferred embodiment.
Figure 4:
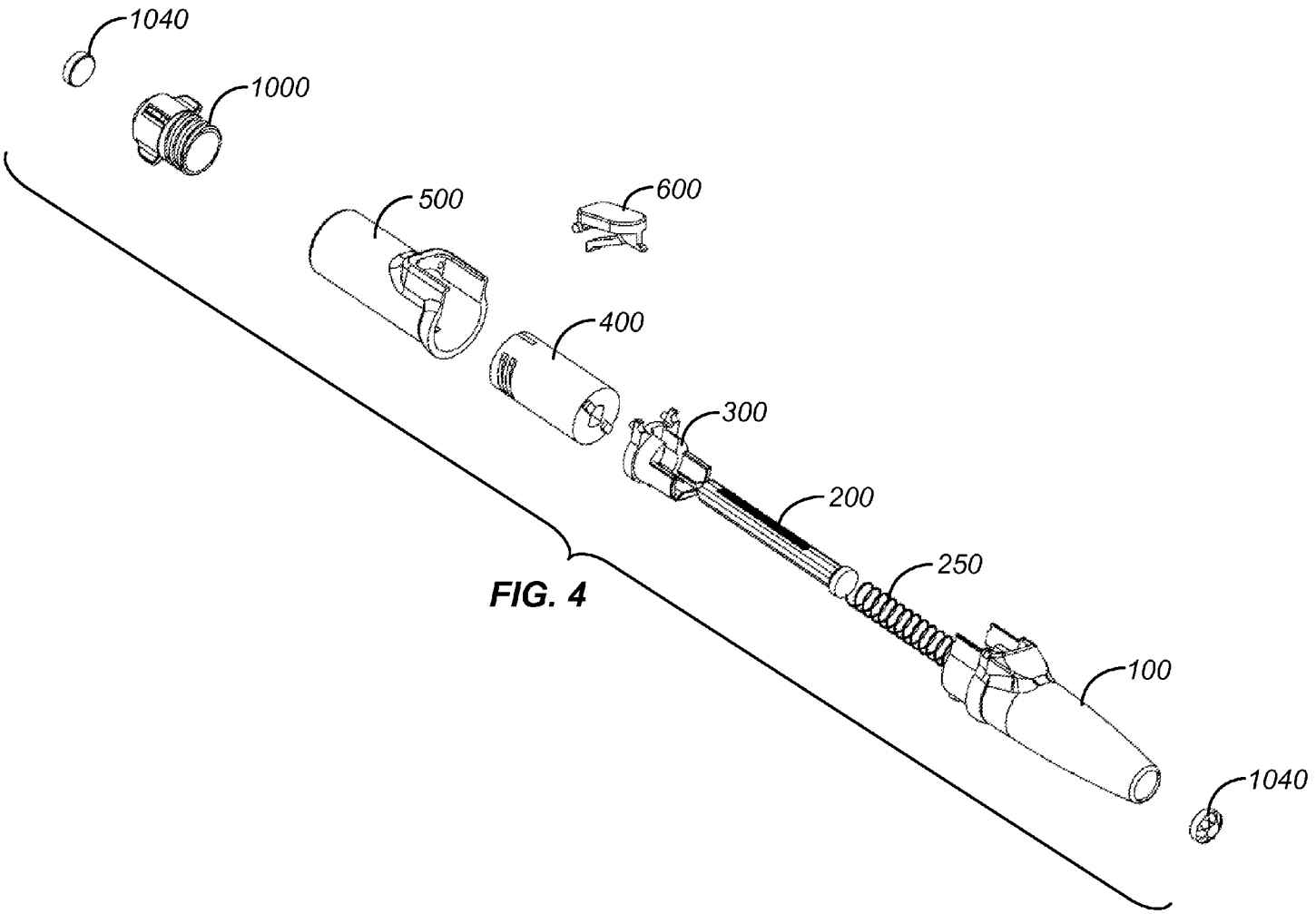
FIG. 4 is an isometric exploded view of an alternative embodiment of the device with a pen cap and decorative jewel.
Figure 5:
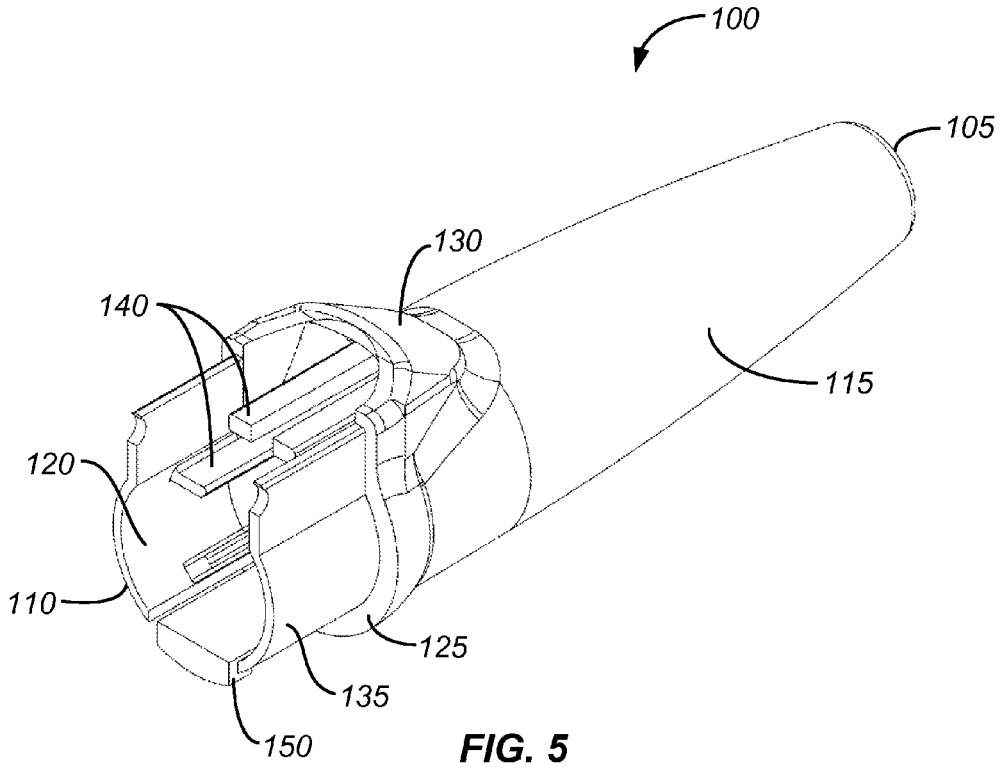
FIGS. 5 and 6 are isometric views of the posterior or rear jacket.
Figure 6:
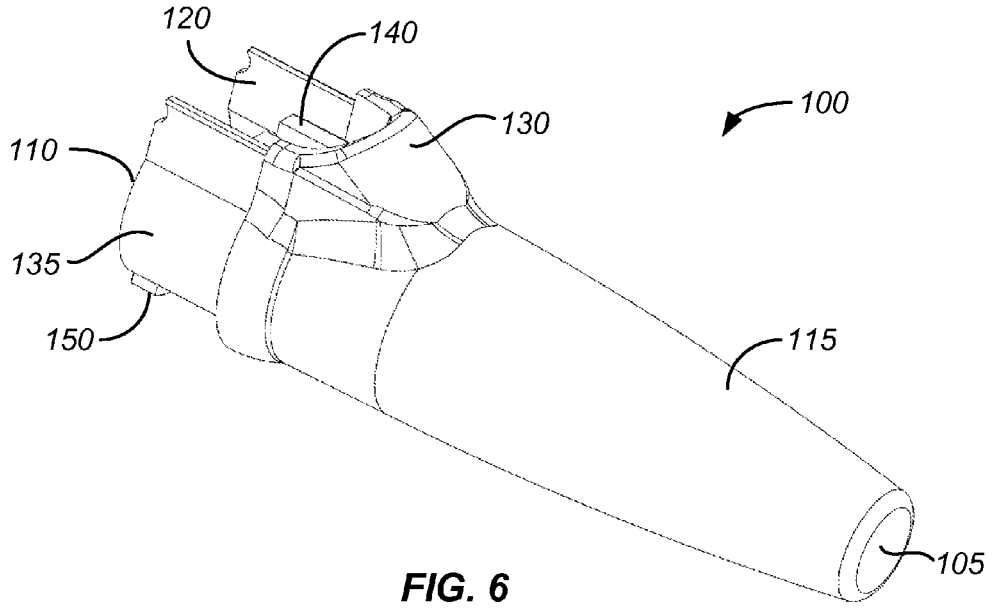
Figure 7:
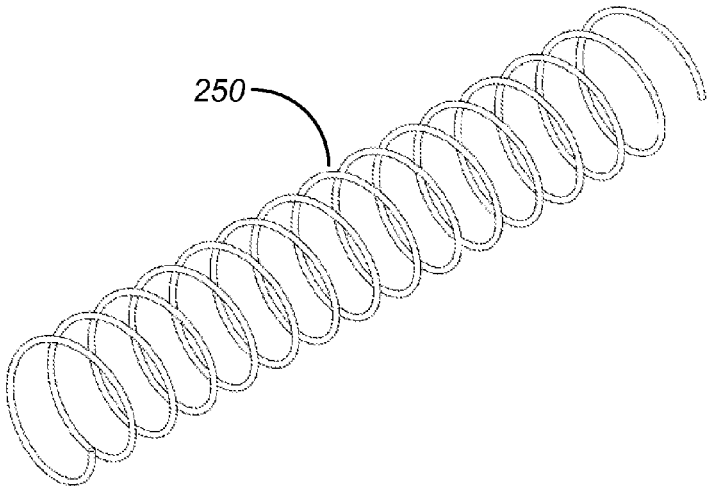
FIG. 7 is an isometric view of the ratchet rod compression spring.
Figure 8:
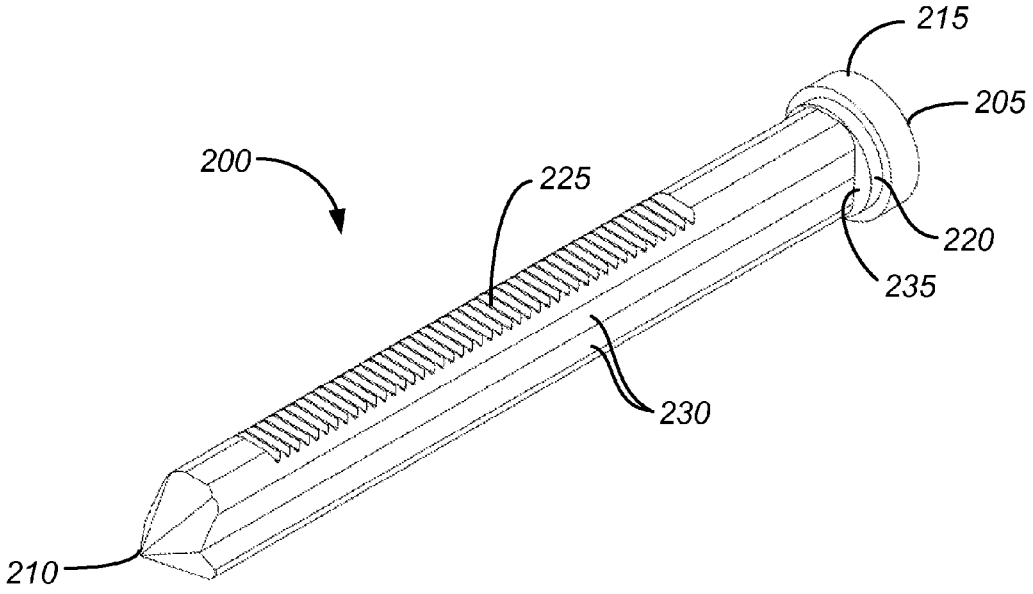
FIG. 8 is an isometric view of the ratchet rod having splined teeth on one engagement surface.
Figure 9:
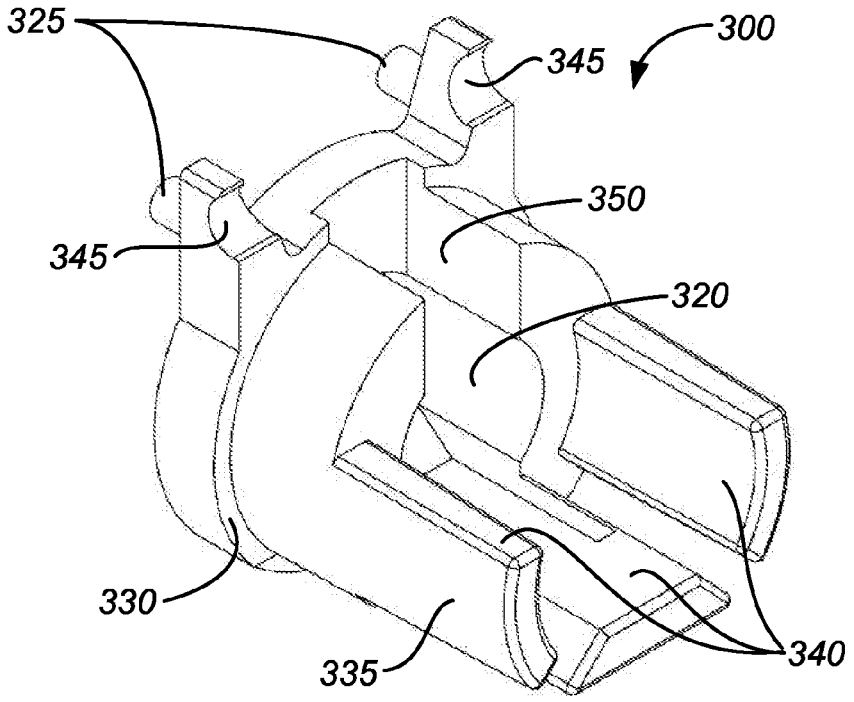
FIGS. 9 and 10 are isometric views of the button carriage.
Figure 10:
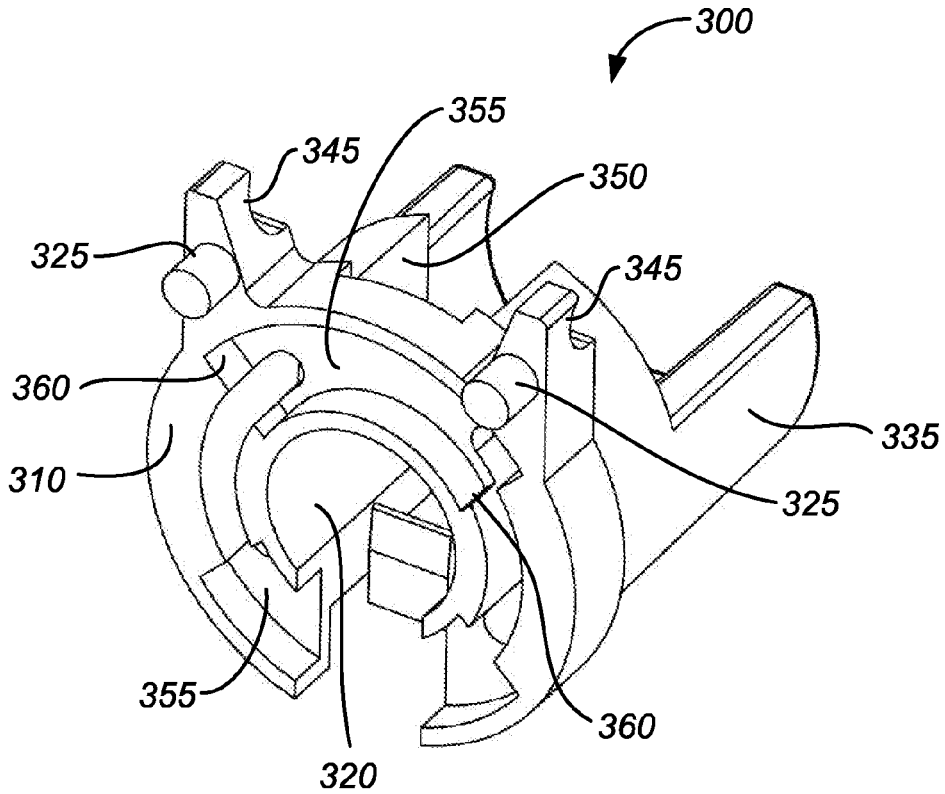
Figure 36:
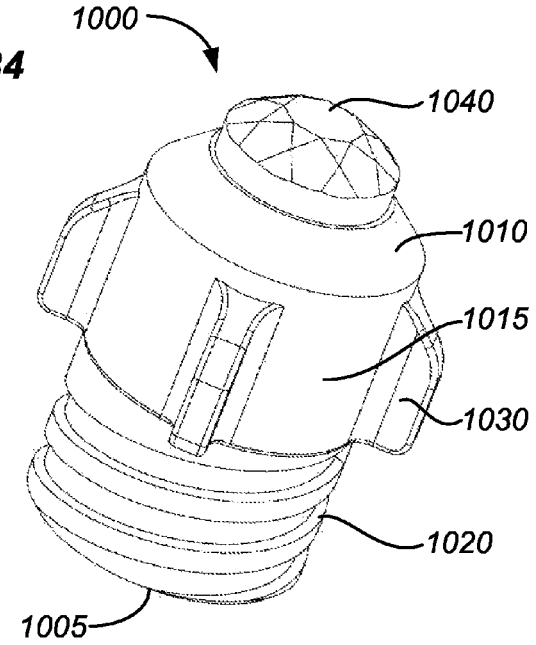
FIG. 36 is an isometric view of an assembled decorative pen cap and jewel ornament.

For example the exploded illustration shown in FIG. 3 demonstrates a version of a pen assembly 15, (also shown in FIG. 2) having a pen body sub assembly 20 comprising; a posterior jacket 100 having a proximal button housing 130, a ratchet rod compression spring 250 with a low spring rate, a ratchet rod 200, having a major diameter 215, splined teeth 225 on one side and non-splined sides 225 on all other surfaces, a button carriage 300, an anterior jacket 500 having an outside diameter 515, a first end 505 and a proximal button housing 530, an activator button 600, a barrel key 400 capable of holding a cartridge 700 within barrel key inside diameter 435, and the barrel key outside diameter 415 inserts inside the anterior jacket housing 520 and, in this illustrative example, either a universal cartridge 700 with an optional special tip attachment 902, or a temporary protective cap 1000, comprising a first end 1005, a second end 1010, an outside diameter 1015, wing features 1030 and a decorative jewel feature 1040, as shown in FIG. 4 or 36, could easily be substituted and replaced with a myriad of alternative components such as a tip holder 808, 850 for alternative tip attachments.

The pen dispenser 20, comprises further flexibility, as illustrated in the component FIGS. 5-15, wherein said posterior jacket 100 comprising a closed end 105, an open end edge 110 and outside diameter 115 and having said proximal button housing 130, internally accepts a ratchet rod compression spring 250 with a low k spring force, and ratchet rod 200, wherein the ratchet rod compresses the compression spring, and wherein the button carriage 300 slides over, and captures the rod shoulder 235 with minor diameter 220 at distal end of the ratchet rod 205, within the inner diameter 320 of the button carriage, compressively retaining the ratchet rod compression spring 250, aligning with, and engaging the internal capture features 120 and 140, of the posterior jacket and button carriage 320, 335, 340, 350. Further, the barrel key 400, slides over the protruding ratchet rod 210 with splined teeth on only one side, capturing and uniquely aligning the rod within a shaped hole 420 in the distal end 405 of the barrel key at a fixed orientation to prevent mis-alignment; wherein two protruding distal detents 425 on the distal surface of the barrel key engage a capturing groove 355, 360 in the proximal surface 310 of the button carriage 300 to align the two components. The anterior jacket 500 having a proximal button housing 530 with internal button carriage alignment holes 525 and capture rails 540 and inner diameter 535, aligns with, slides over, and simultaneously captures the barrel key 400, the button carriage 300, the button carriage alignment pins 325, and the outer diametral capture features 135, 125, 150 of the posterior jacket 100, simultaneously aligning with the proximal button housing 130, and forming a fully assembled button housing (130/530), wherein the activator button 600 comprising, a rounded end edge 605, a flat end edge 610, a top surface 615, side edges 620, pivot pins 625, and a tip 635, is inserted, and captured by the button carriage pivot rockers 345 and button notch 350. Once inserted, the activator button 600 aligns the ratchet tooth leaf spring 630 with a non-splined side 230 of the ratchet rod 200 within the pen body. In this condition, the pen dispenser sub assembly is ready to accept cartridges 700, and a myriad of tip adapter assemblies.

Figure 11:
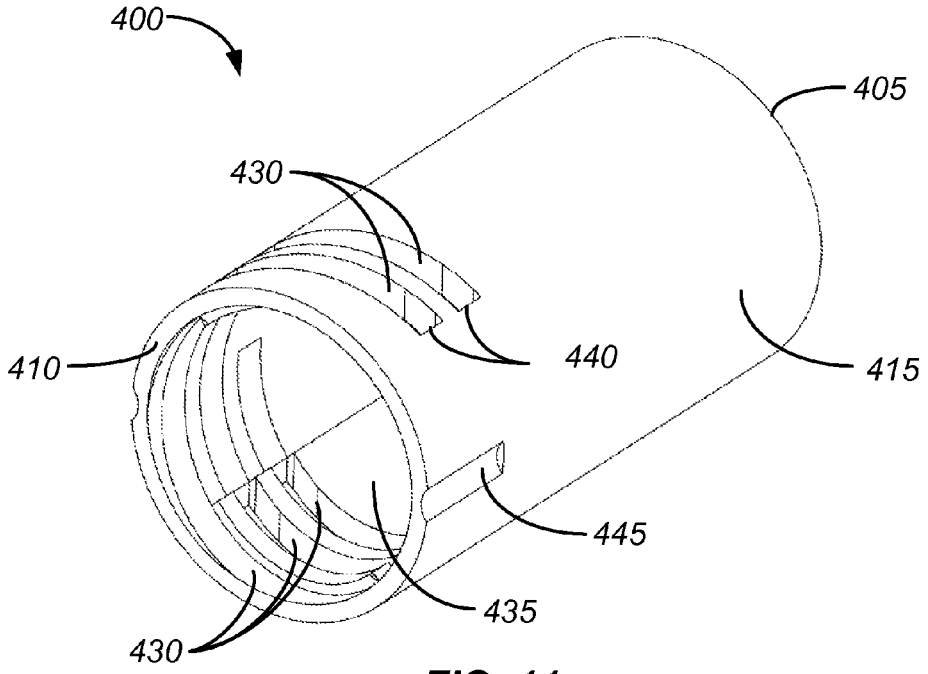
FIGS. 11 and 12 are isometric views of the barrel key.
Figure 12:
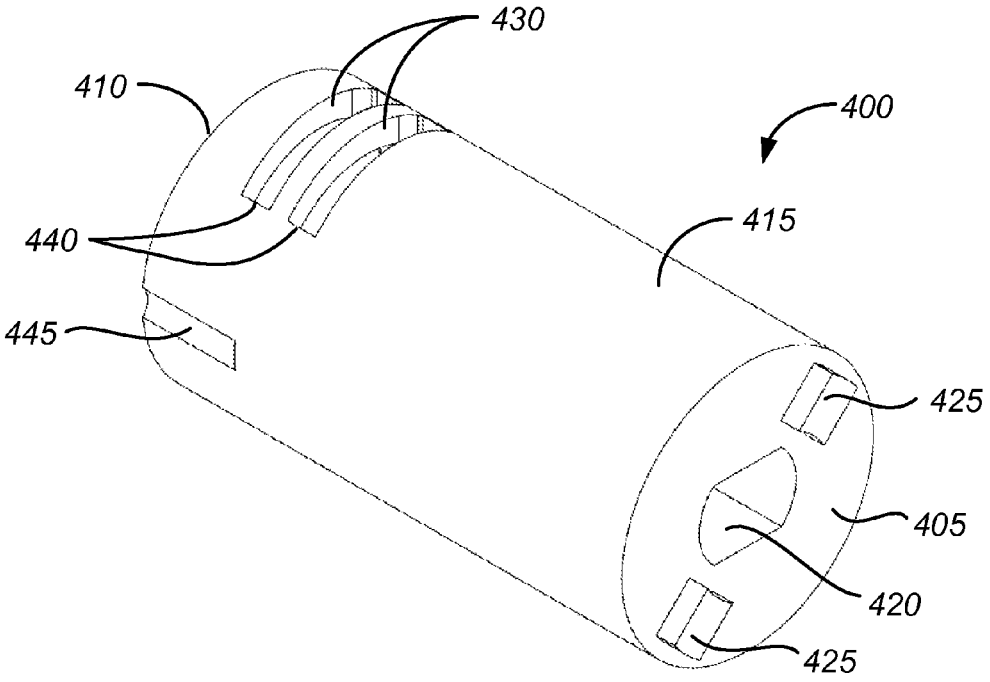
Figure 13:
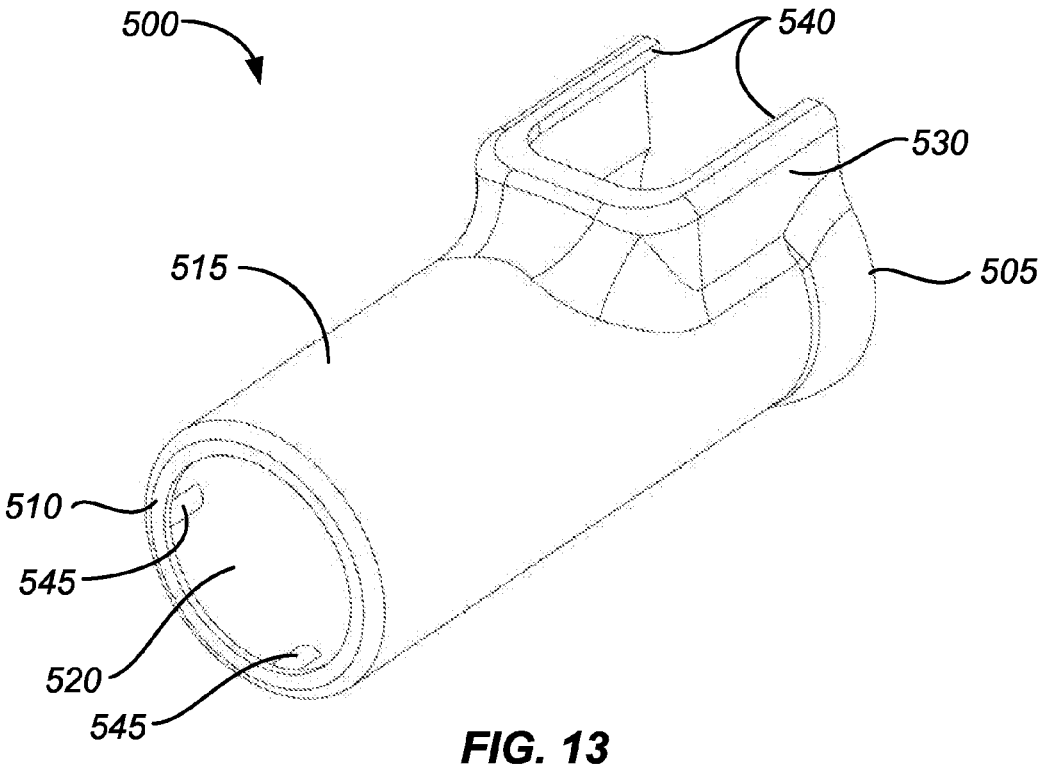
FIGS. 13 and 14 are isometric views of the anterior or front jacket.
Figure 14:
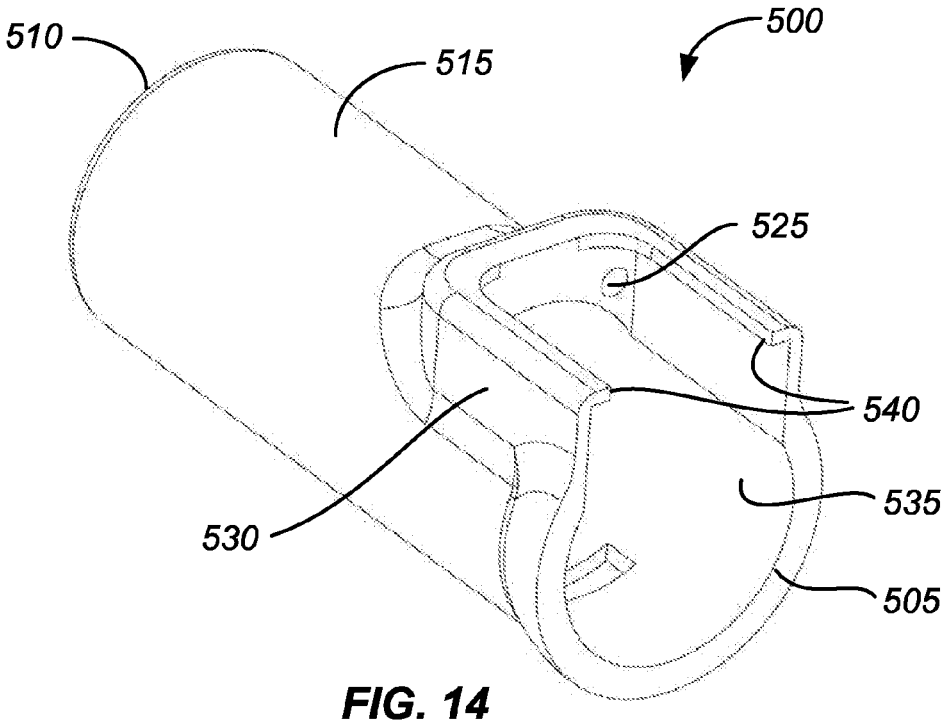
Figure 15:
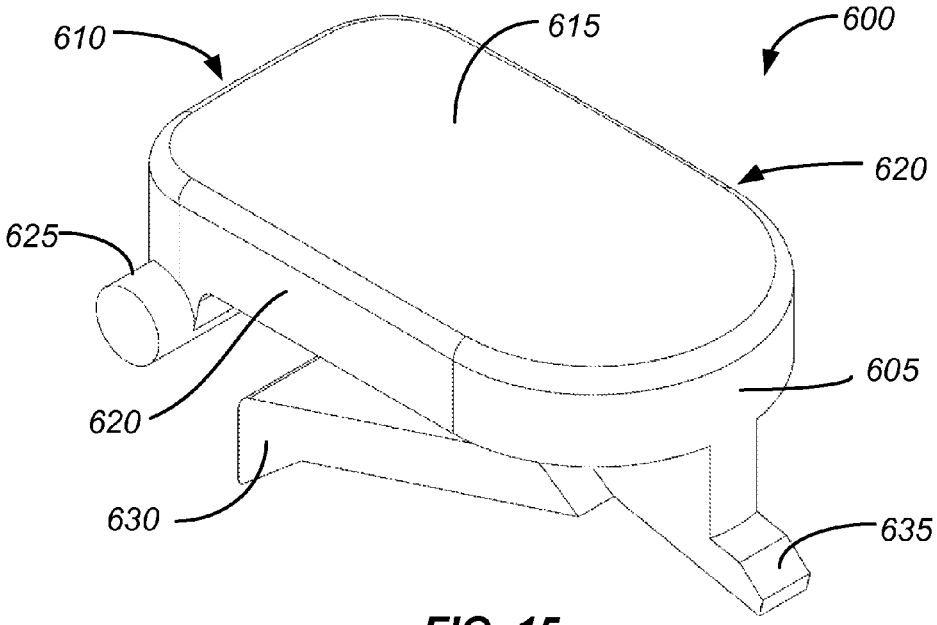
FIGS. 15 and 16 are isometric views of the activation button.
Figure 16:
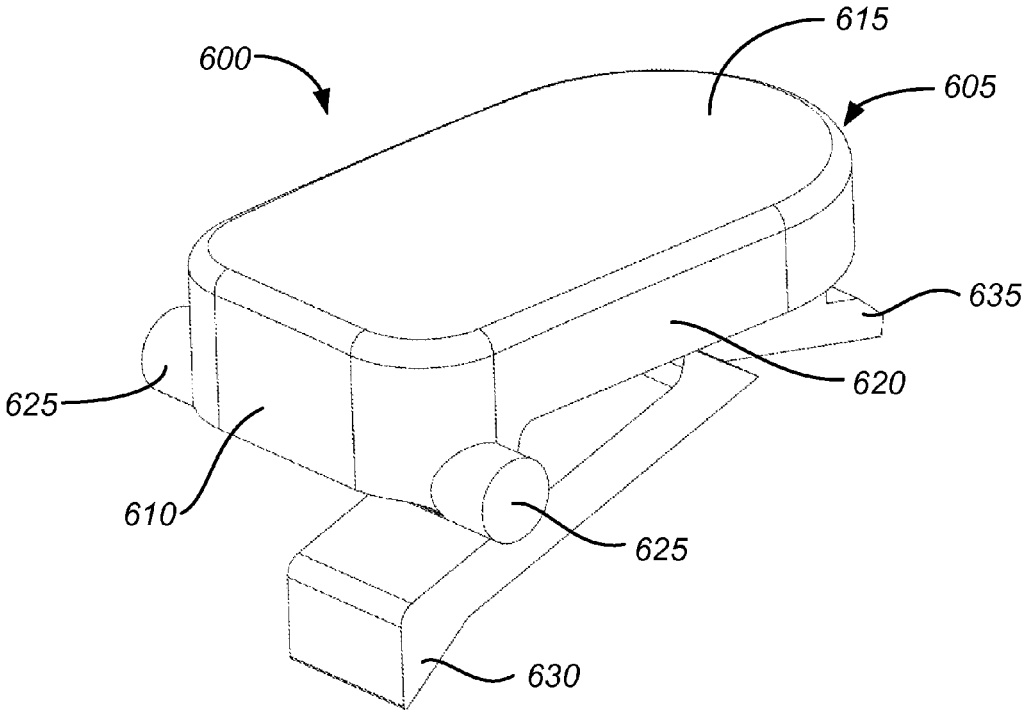
Figure 19:
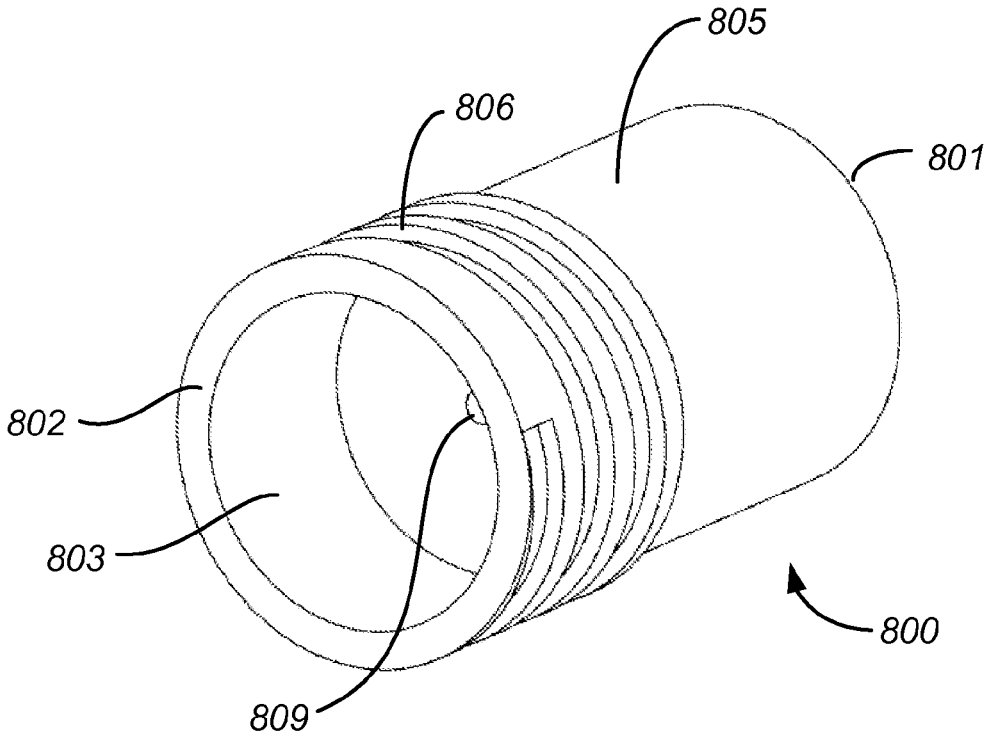
FIG. 19 is an isometric view of a tip holder or adapter.
Figure 20A:
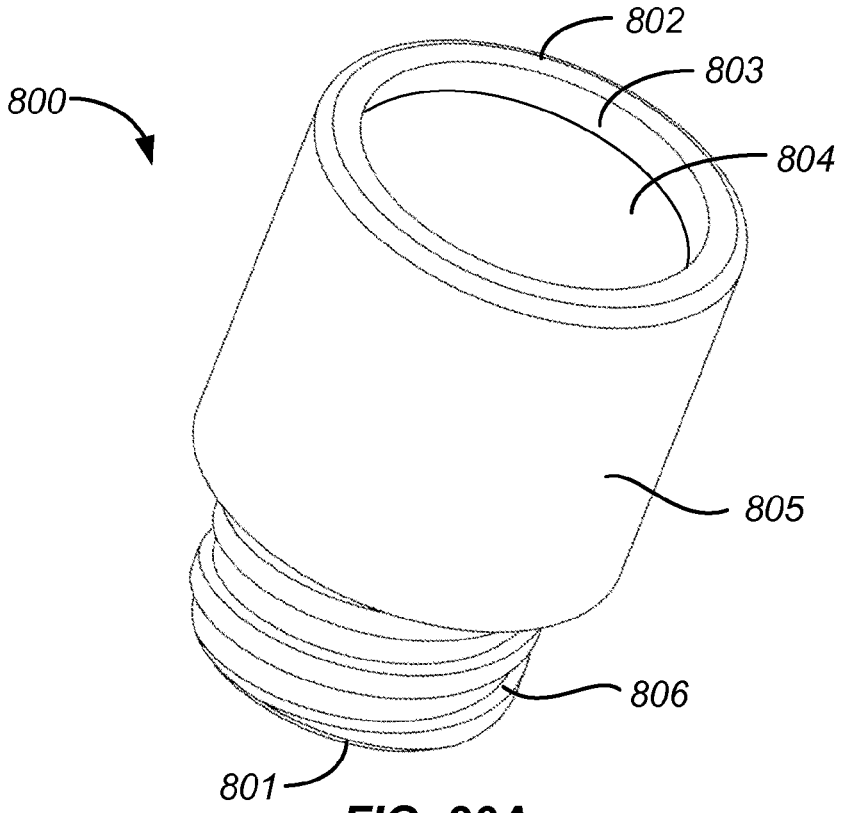
FIG. 20A is an isometric view of an alternative tip holder or adapter.
Figure 33A:
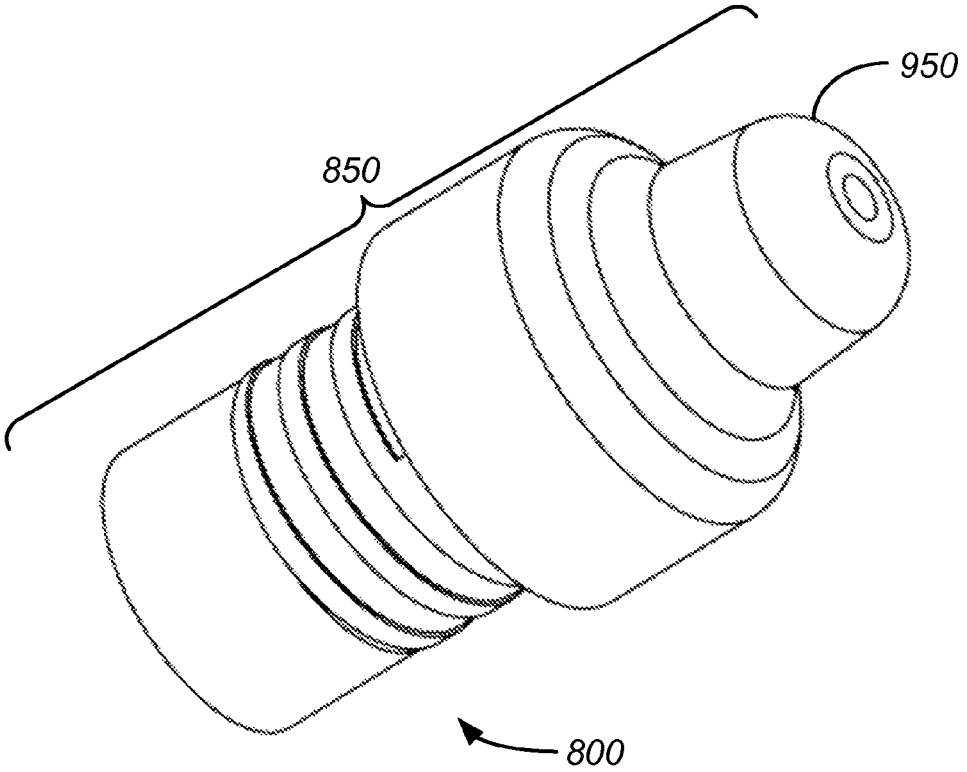
FIG. 33A-33B are isometric views of another preferred embodiment of an alternative tip holder that can accept various applicator tips.
Figure 33B:
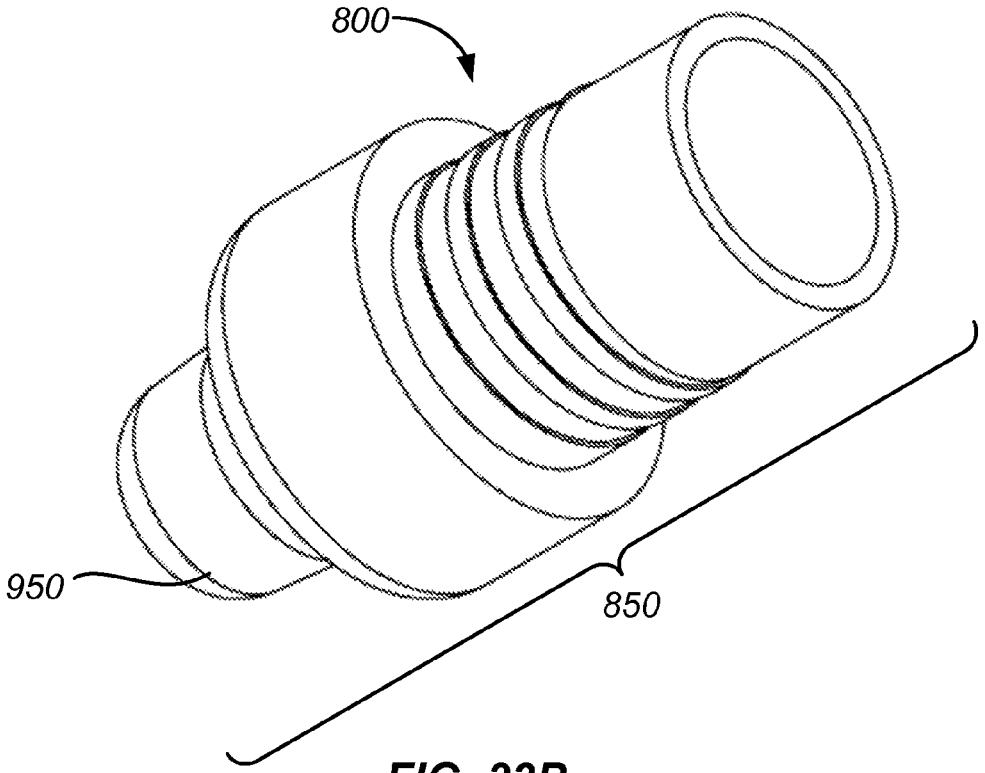
Figure 33C:
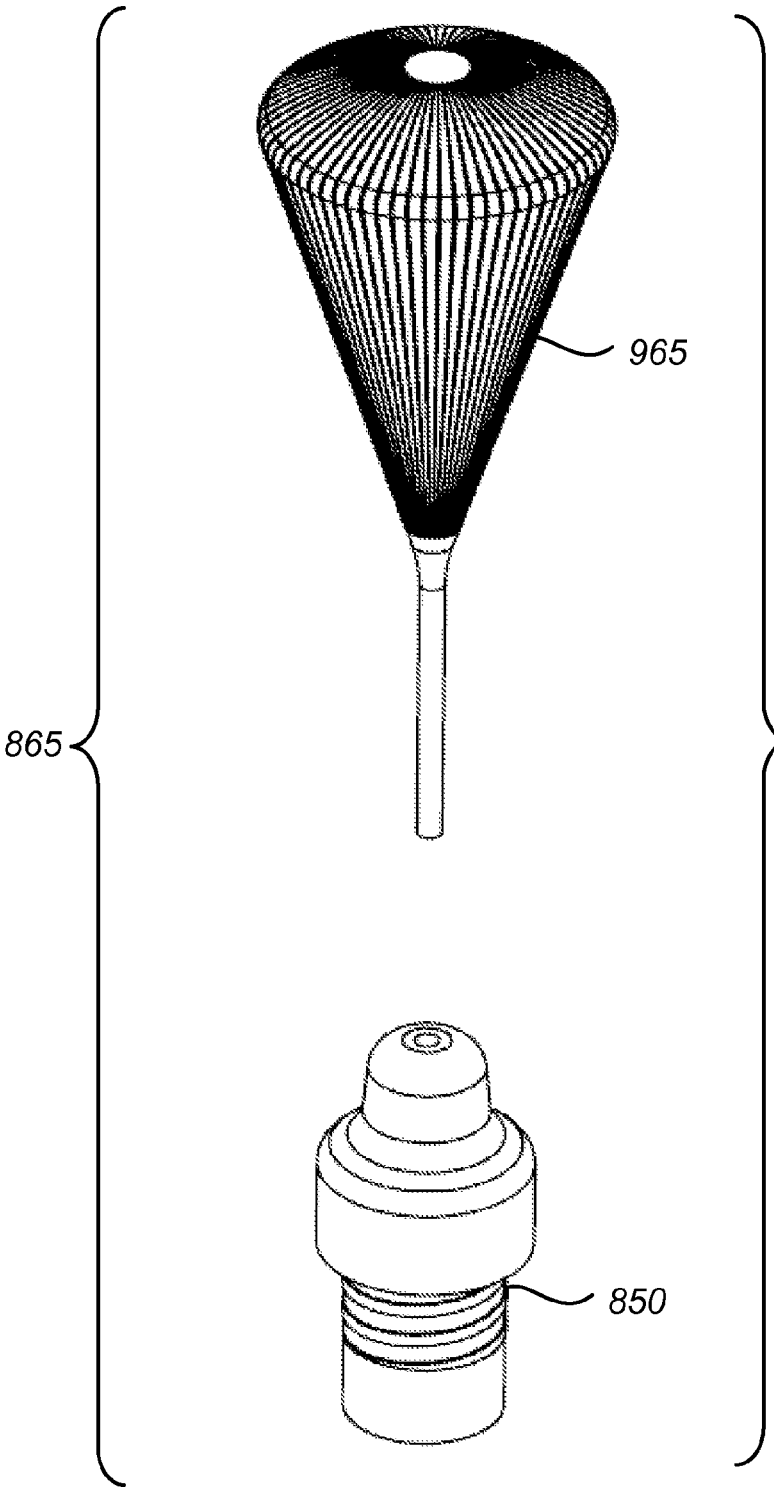
FIG. 33C is an exploded view of the alternate tip holder of 33A&B with a broad cosmetic brush
Figure 34:
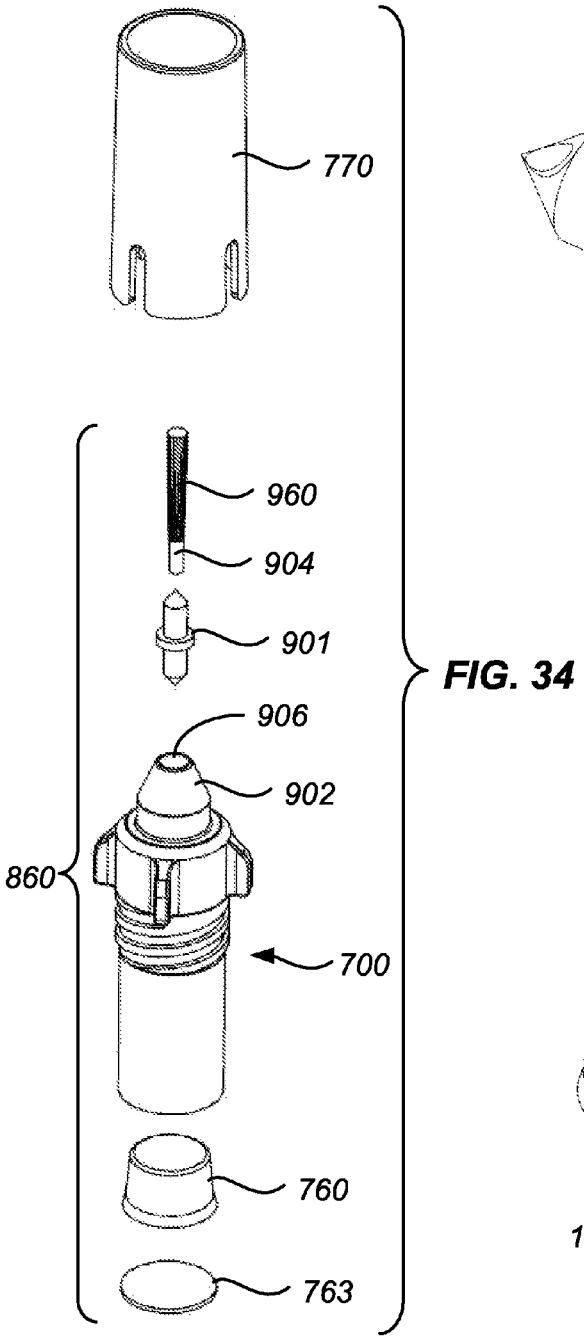
FIG. 34 is an isometric view of a preferred embodiment of an exploded cartridge with a spike, a nail polish brush, a protector cap, a piston and seal.

In some embodiments of the pen dispenser 20, the barrel key 400, as illustrated in FIGS. 11 and 12, is capable of accepting a multitude of interchangeable components comprising; universal cartridges 700, optionally filled with flowable material, and capable of accepting a multitude of interchangeable tip adapter assemblies 810-870, tip holders and adapters 800, 808, 850, as shown in FIGS. 19, 20, and 33, which in turn can accept a special tip attachment 902, or a holder/spike 901 capable of accepting at least one other, typically non-standard interchangeable tip applicators, i.e.: 960, as shown in FIG. 34, and/or alternately, accepting temporary caps 1000 as shown in FIGS. 4 and 36.

Figure 17:
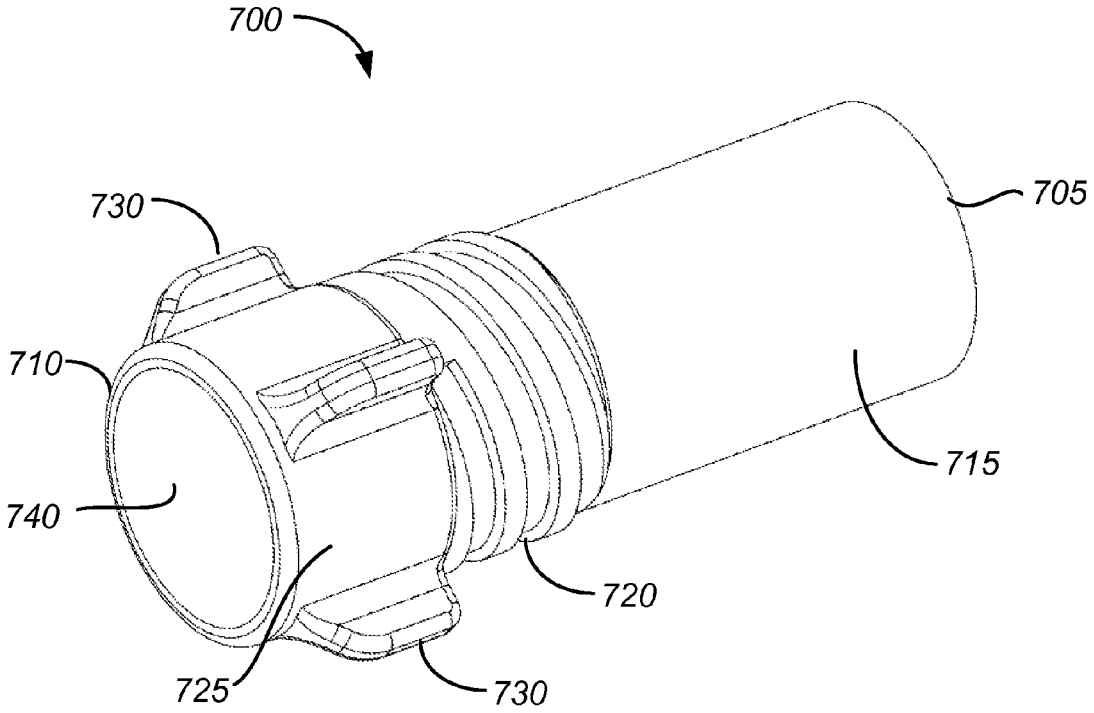
FIGS. 17 and 18 are isometric views of the preferred embodiment of a universal cartridge body.
Figure 18:
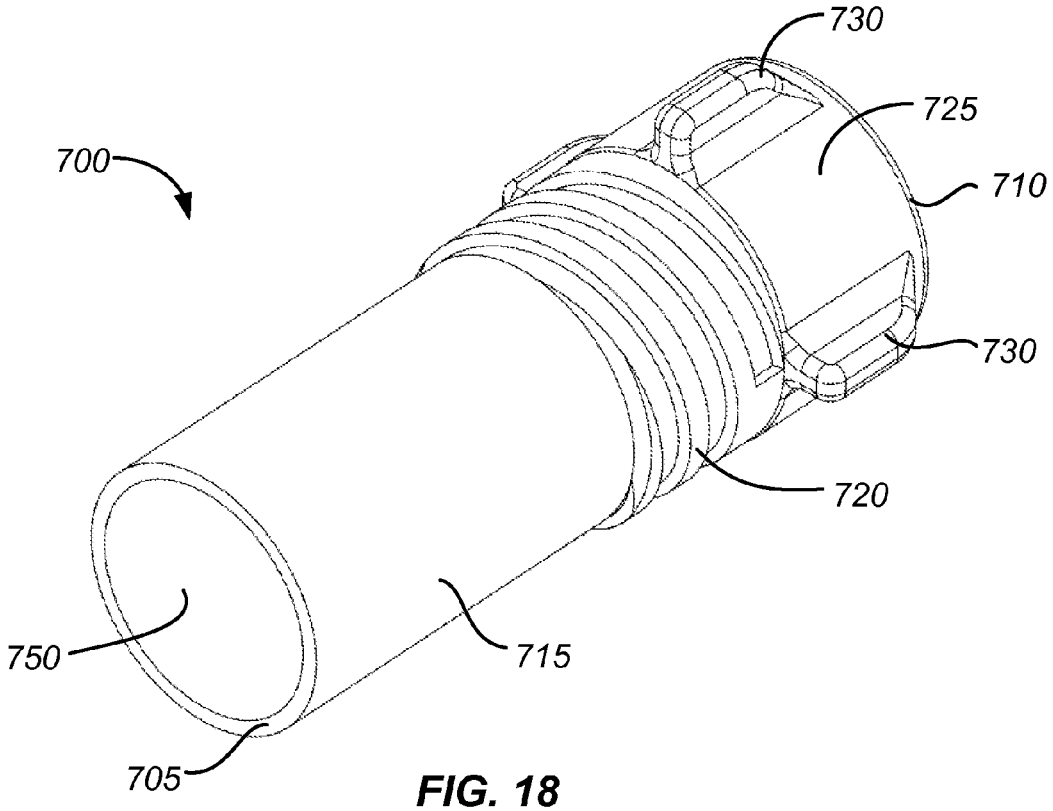
Figure 21:
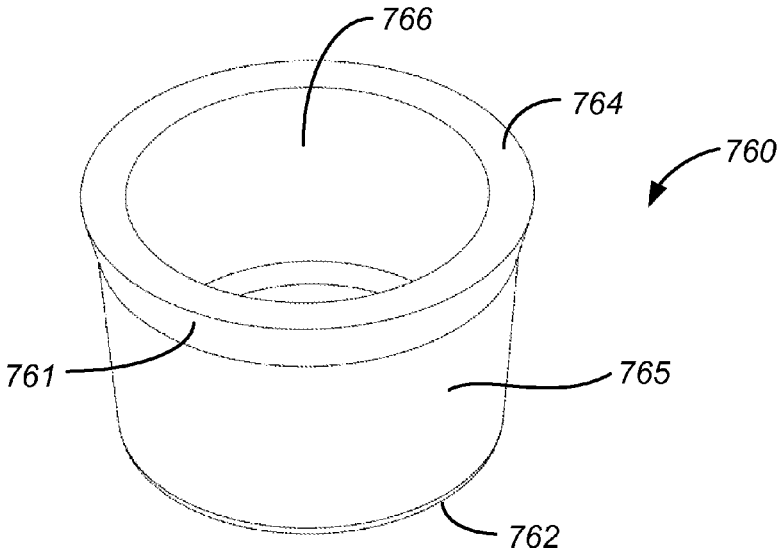
FIG. 21 is an isometric view of the cartridge ram piston.
Figure 22:
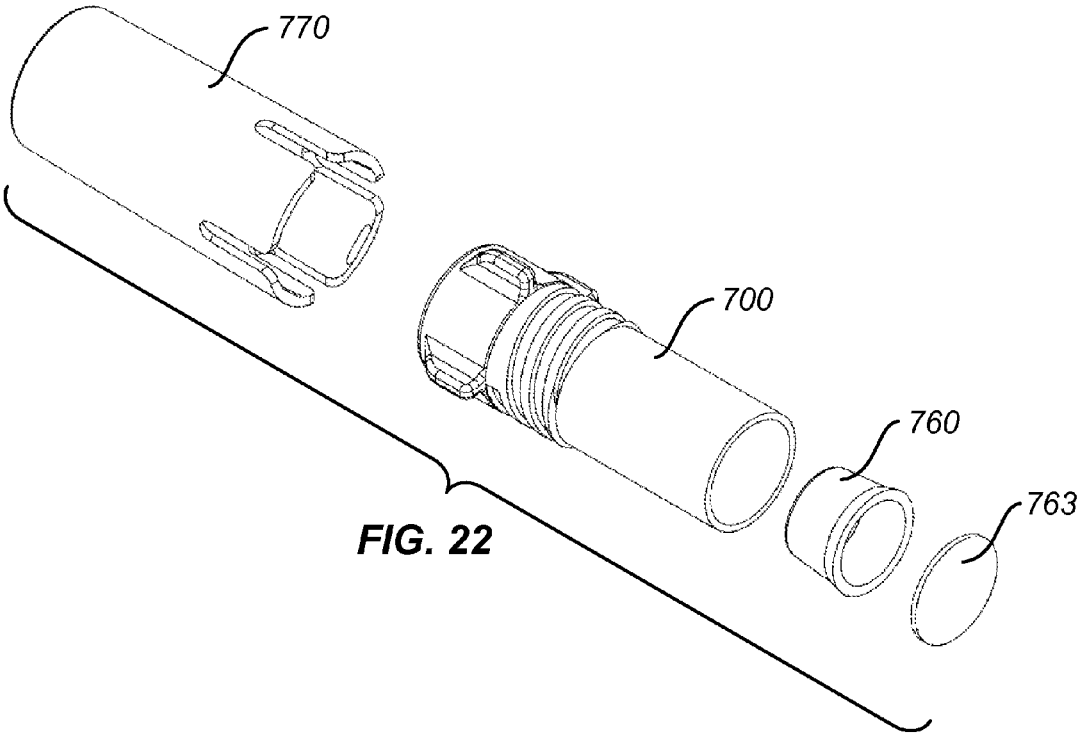
FIG. 22 is an exploded isometric view of a preferred embodiment of the cartridge assembly and slotted cap, (without an interchangeable tip or tip assembly).

In some embodiments, the universal cartridge 700 illustrated in FIGS. 17, 18 and 22 comprises; a tubular body having a proximal 710 and distal end 705, a hollow interior cylinder 750 with a distal opening for receiving optional flowable material, an exterior cylinder with a distal portion 715, a threaded proximal portion 720 and a winged cap portion 730 having an outside diameter 725 proximal to the threaded portion, a proximal opening 740 having a connection mechanism for receiving at least one of interchangeable tip adapter assemblies, tip adapters, or special tip attachment or holder, each capable of accepting at least one interchangeable tip applicator, an optional separable piston 760 comprising a compression ram surface 762, an open end 764, an inside diameter 766, and an outside diameter 765 with a shoulder diameter 761, as shown in FIG. 21, positionable in the distal interior opening of the cylinder 750 for sealing said optional flowable materials therein and for providing a compression ram surface 762 to dispense said flowable material, and an optional seal 763 positionable over the distal end of the cartridge.

In some embodiments, a tip adapter 800 as shown in FIG. 19 comprises; a tubular body having a proximal 802 and distal end 801, a hollow interior cylinder 803 with a distal opening, an optional central barrier with a thru-hole 809, an exterior cylinder with a distal portion, and a threaded proximal portion 806, wherein said distal portion comprises a base 805 having a connection mechanism for insertion into the proximal end of said cartridge 740, a proximal opening 803 having a connection mechanism for receiving at least one interchangeable tip applicators such as 910, 915, 925, 950 or 970 as shown in FIGS. 20C, 26-28 and 33, or tip applicators such as 930, 935, 945 as shown in FIGS. 29-32 with special tip adapters 903 capable of accepting said interchangeable tip applicator.

Upon review of the Figures, it should be understood by the reader that the universal cartridges may be easily converted to an alternate interchangeable tip adapter by simply removing the piston and air-tight cartridge seal, thus creating the equivalent of an alternate tip adapter, and equally capable of receiving a myriad of available interchangeable tip applicators. The reader should also understand that in this application, the terms cartridge 700 and tip adapter 800, 808, 850 are often used interchangeably. In addition, the reader should understand that a tip applicator assembly (i.e.: 810, 815, 825, 830, 835, 840, 845, 860) can be assembled with either a cartridge 700, or tip adapter 800, as a component of the assembly.

In some embodiments, the interchangeable tip applicator assembly (i.e.: 810, 815, 825, 865) comprises; a tip adapter 800, 808 or 850 and at least one interchangeable special tip attachment (i.e.: 910, 915, 925), or holder capable of accepting at least one interchangeable special dispensing tip (i.e.: 930, 935, 965, 970), which may also be interchangeable with a universal cartridge.

In some embodiments of tip adapter assemblies, the cartridge accepts a special tip attachment 902, as shown in FIG. 34, capable of receiving a "spike" designed to hold fine bristle brushes 960, wherein each component has a mating connection mechanism 904, 906 for that type of assembly.

In some embodiments, the connection mechanisms comprise; a press-fit connection, a taper connection, a compression fitting connection, a threaded connection, a bayoneted connection, or a snap-fit connection. As illustrated in FIGS. 3, 4, 11, some embodiments of the pen dispenser show that the barrel key 400 having an outside diameter 415, is a hollow tubular structure with an open proximal end 410 capable of accepting the cartridge 700 or alternative tip adapter 800, 808, 850 1000, and having a closed distal end 405 with a shaped opening 420 therethrough for selectively receiving the ratchet rod 200 at a fixed rotation (along the non-splined surface 230), away from the engagement angle necessary to contact the activator button ratchet tooth leaf spring 630.

In some embodiments, the proximal body of the barrel key comprises internal threads 430, having thread stops 440, for receiving and capturing the threaded external body of the cartridge 720 or alternative tip adapter 806, 850 or temporary cap thread 1020.

In some embodiments, the cartridge is fully engaged in the barrel key as illustrated in FIGS. 1 and 2, and the barrel key is twisted in a clockwise rotation, typically 90°, causing the ratchet rod 250 to simultaneously and synchronously rotate until the splined teeth 225 on the one side of the ratchet rod engage with the activator button ratchet tooth leaf spring 630. As would be apparent to one skilled in the art when viewing FIG. 3, when rotated and engaged, the ratchet rod 200, will advance anteriorly due to the posteriorly placed, low-spring-rate, compression spring 250, and under the compressive load of each push on the activator button 600, pushing the splines 225 on the ratchet rod. In some embodiments, the ratchet rod will anteriorly advance the distance of one or more splined teeth at a time, depending on the spring rate selected for the ratchet rod compression spring.

In some embodiments, the anterior end of the ratchet rod 210 penetrates the seal 763 of the cartridge and compressing the piston 760 and dispensing the flowable material contained therein out of the cartridge 700 and through the attached tip applicator assembly (i.e.: 810, 815, 825) as illustrated in FIGS. 26-30 and 32.

Figure 25:
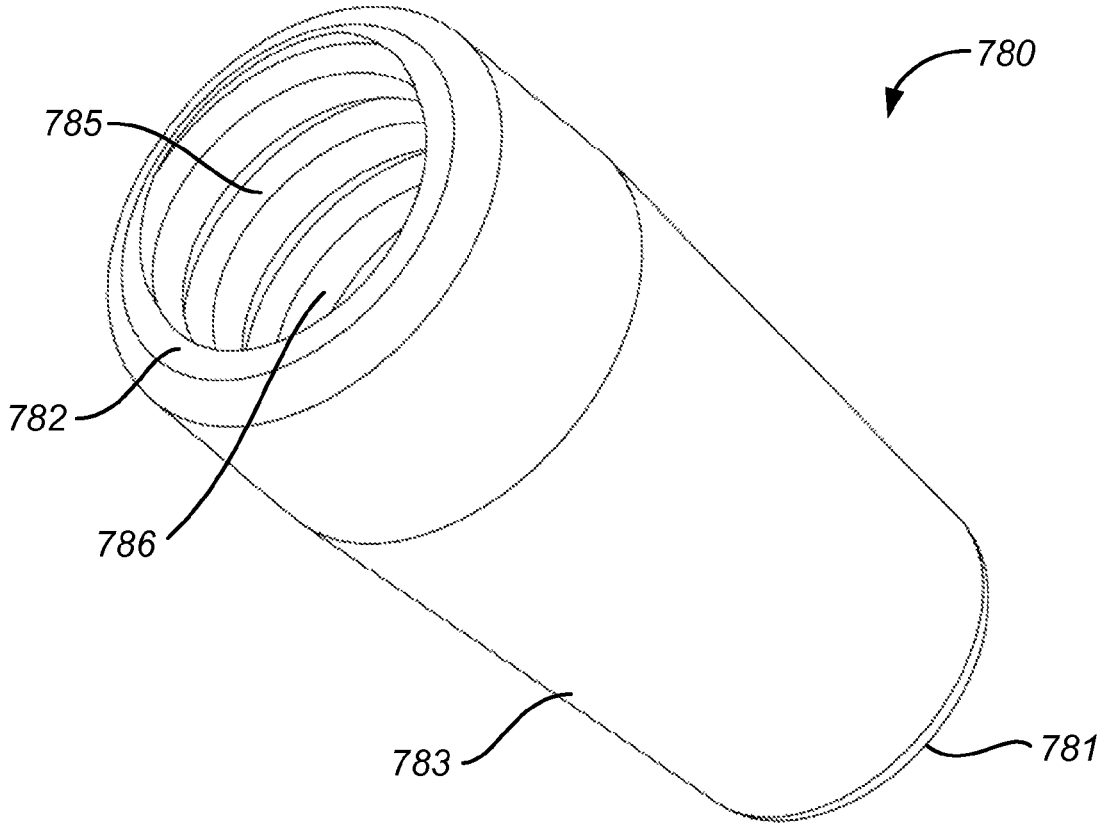
FIG. 25 is an isometric view of an alternative embodiment of a threaded tip applicator end cap.
Figure 26A:
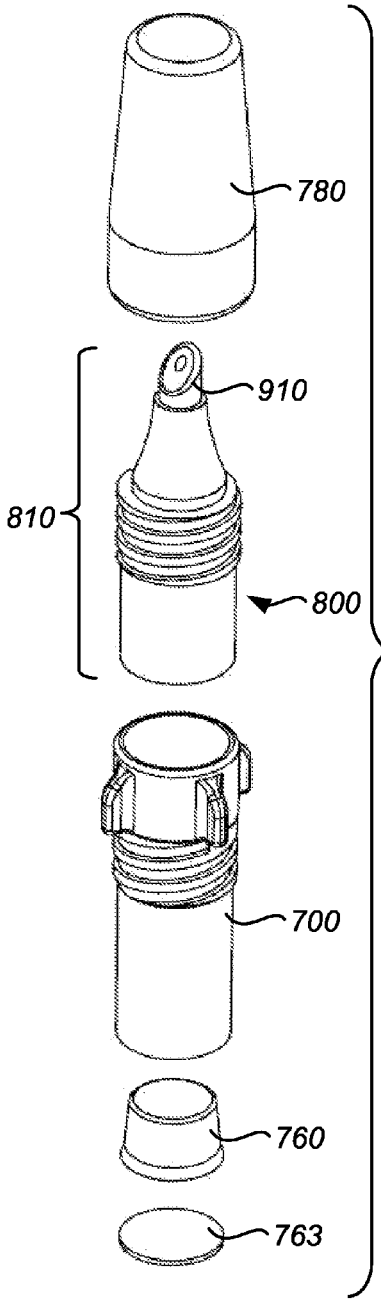
FIGS. 26A-26C are isometric views of a preferred embodiment of an exploded cartridge assembly with an interchangeable tip applicator assembly with tip applicator.
Figure 26B:
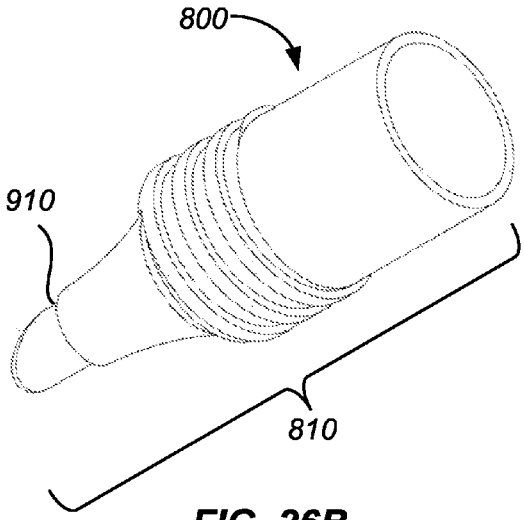
Figure 26C:
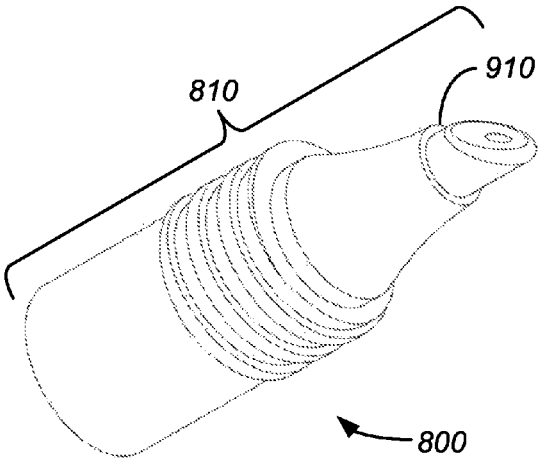
Figure 27A:
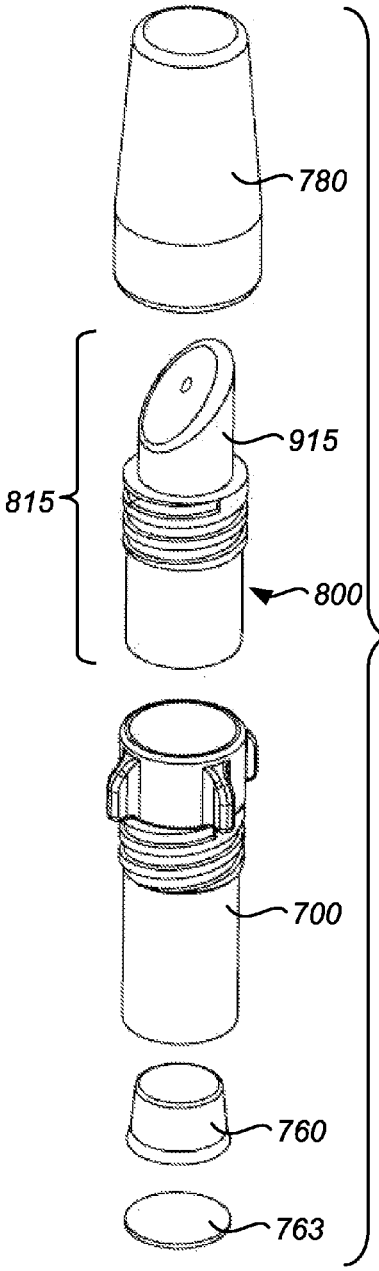
FIGS. 27A-27C are isometric views of another preferred embodiment of an exploded cartridge assembly with an interchangeable tip applicator assembly with tip applicator.
Figure 27B:
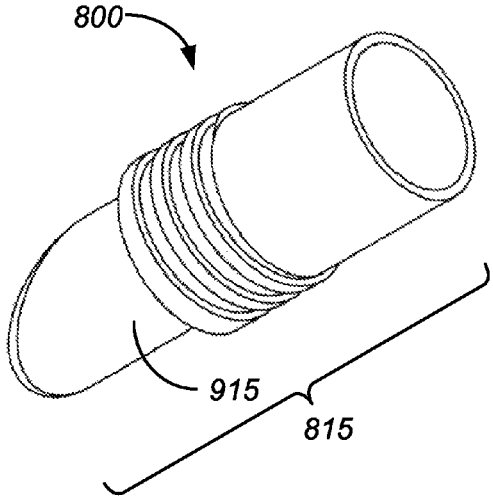
Figure 27C:
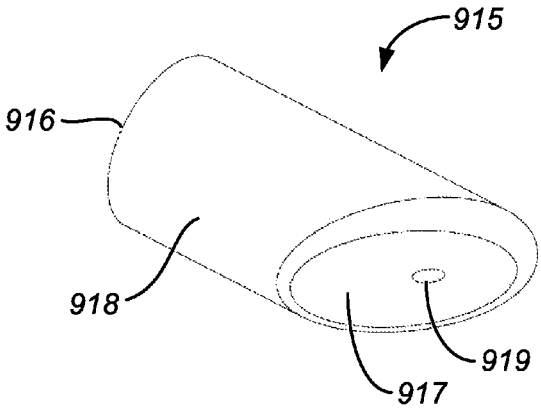
Figure 28A:
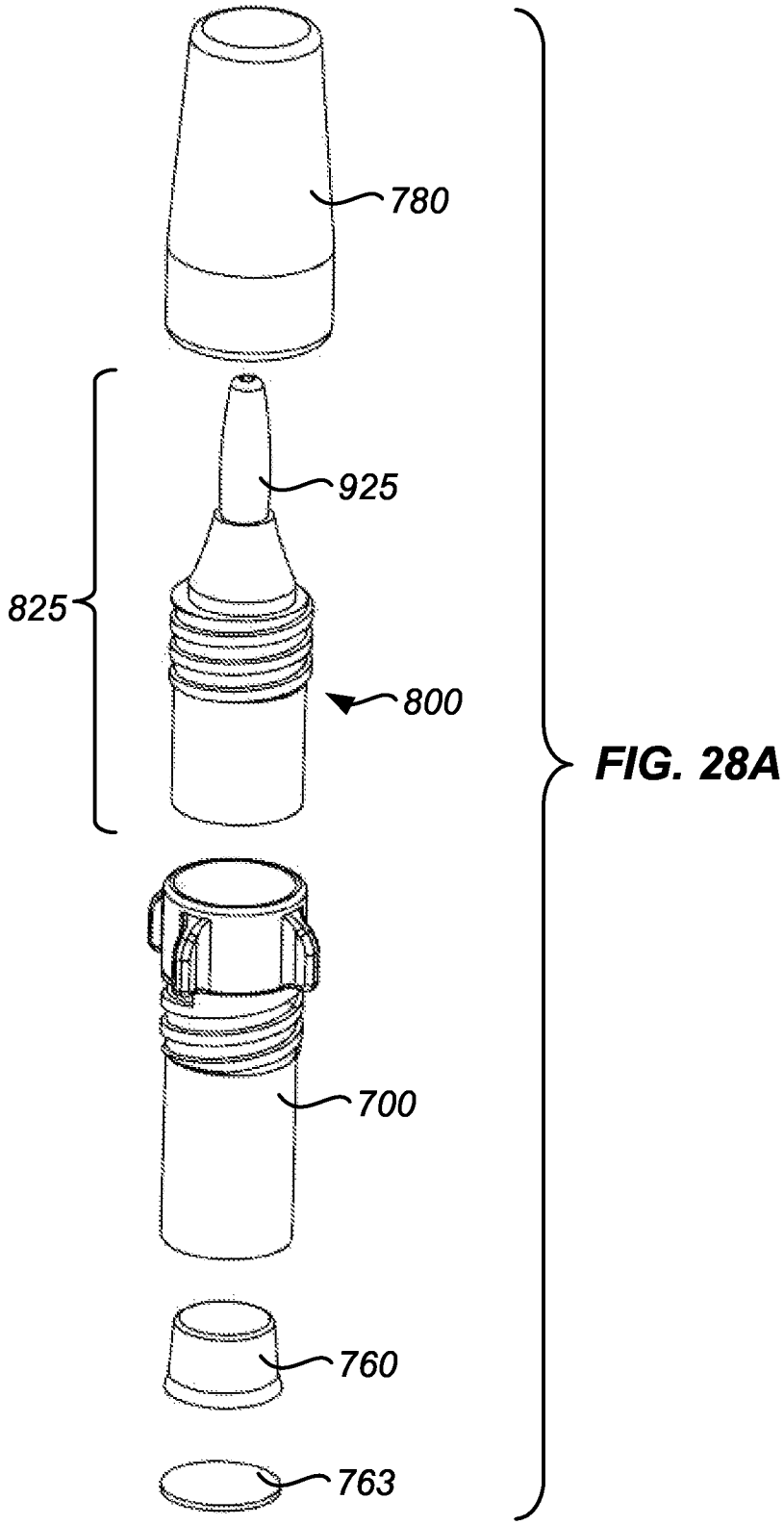
FIG. 28A is an isometric view of yet another preferred embodiment of an exploded cartridge assembly with an interchangeable tip applicator assembly with tip applicator.
Figure 28B:
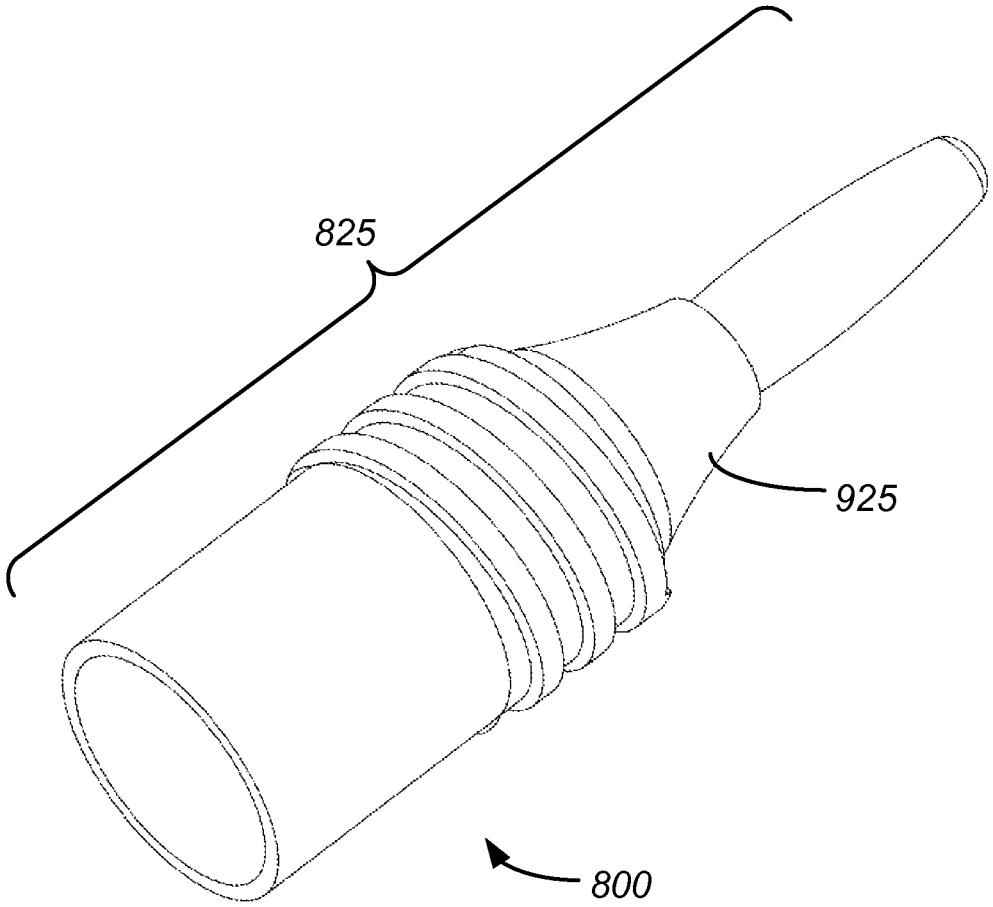
FIG. 28B is an isometric view of a preferred embodiment of a tip applicator assembly and tip applicator.
Figure 29B:
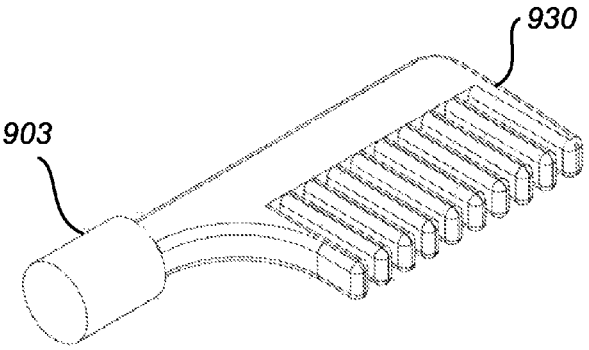
FIGS. 29A-29B are isometric views of still another preferred embodiment of an exploded cartridge and tip applicator assembly for either flowable or non-flowable material with an interchangeable comb tip (piston and seal are optional).
Figure 29A:
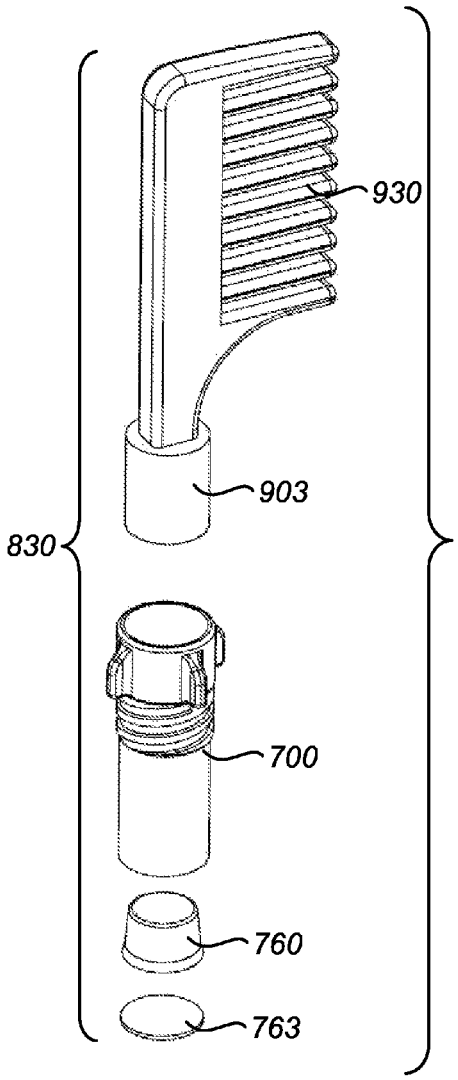
Figure 30A:
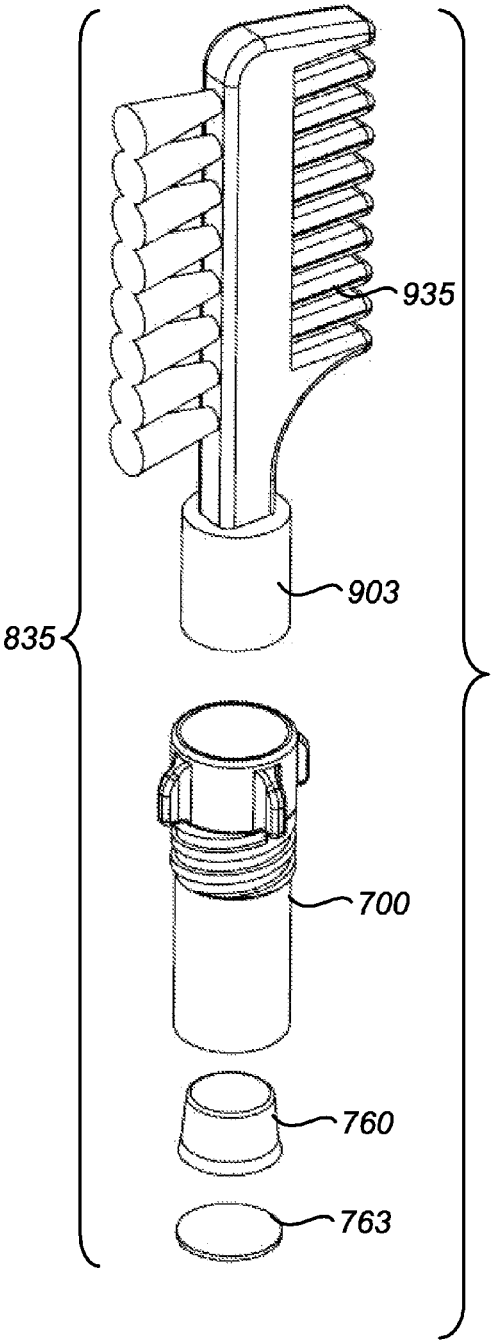
FIGS. 30A-30B are isometric views of yet another preferred embodiment of an exploded cartridge and tip applicator assembly for either flowable or non-flowable material with an interchangeable brush/comb tip (piston and seal are optional).
Figure 30B:
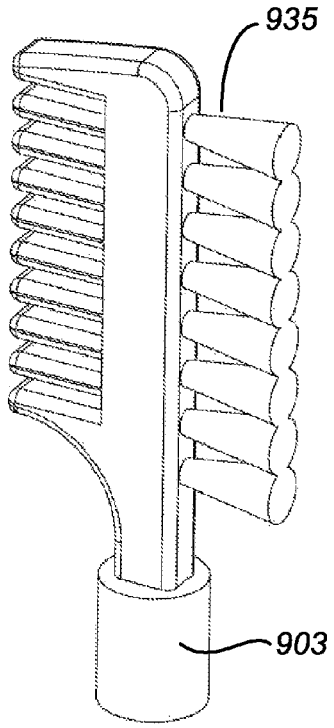
Figure 31A:
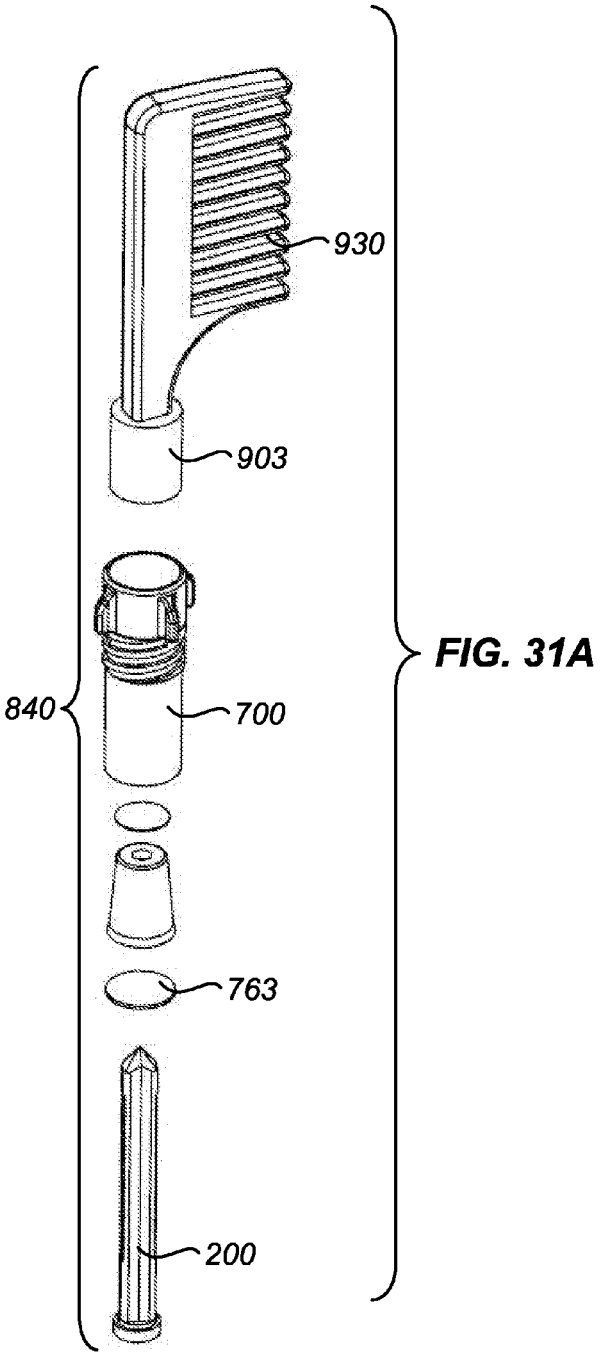
FIGS. 31A-31C are isometric views of yet another alternative embodiment of an exploded cartridge assembly illustrating a multi-part solution cartridge, (i.e.: a two-component system for a hair coloring w/ a dye and activator), a special piston, an inner seal, a ratchet rod/mixing stick to pierce the cartridge compartments and activate the (i.e.: hair color) dye, and an interchangeable comb tip applicator assembly for flowable materials.
Figure 31B:
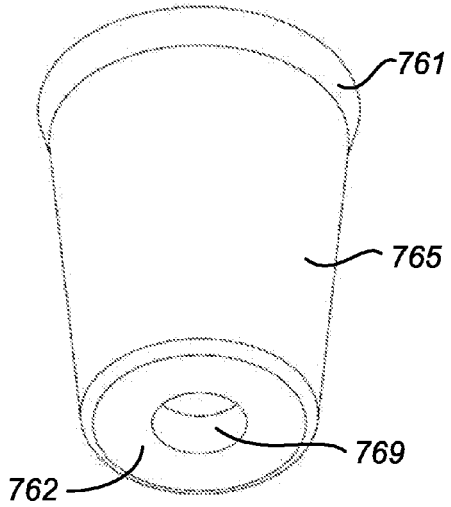
Figure 31C:
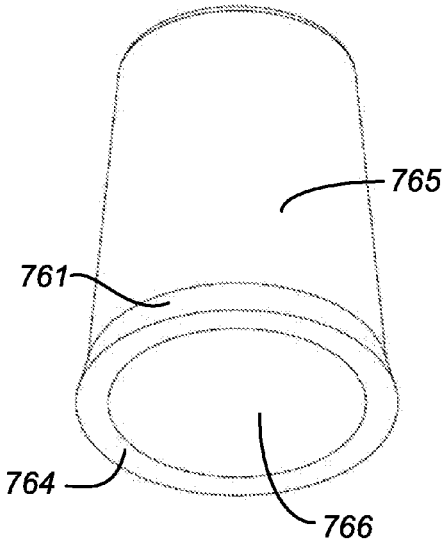
Figure 32A:
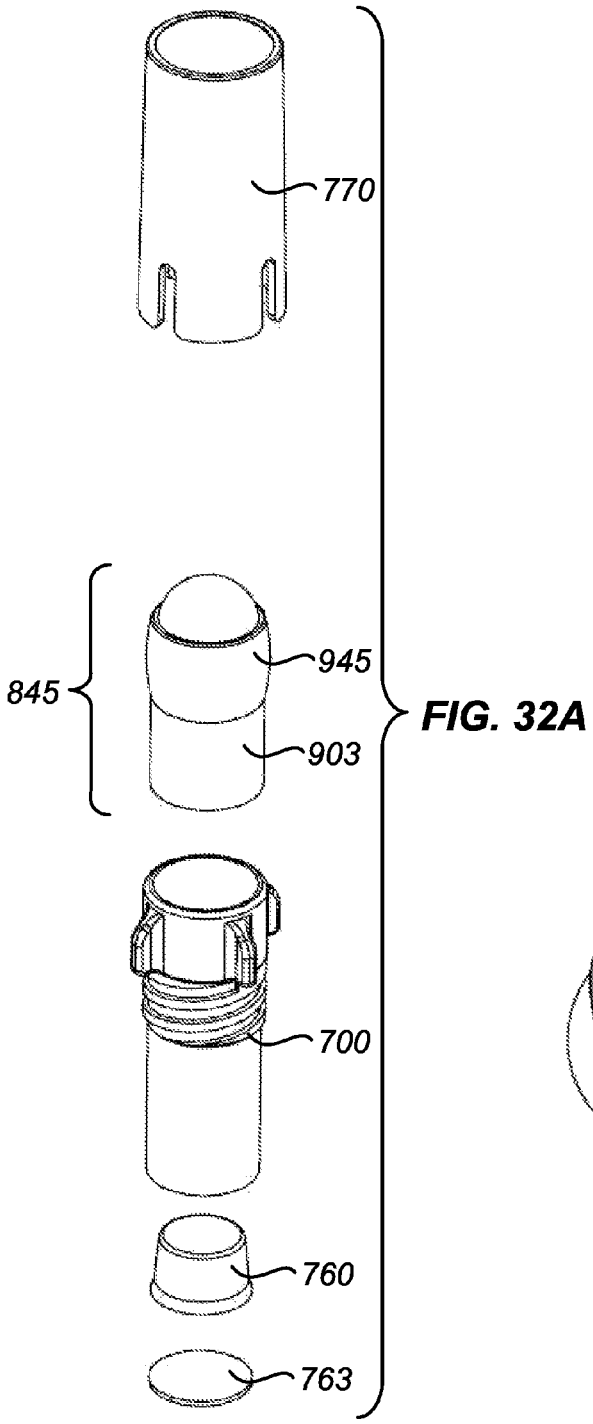
FIGS. 32A-32C are isometric views of still another preferred embodiment of an exploded cartridge assembly comprising a roller ball attachment interchangeable tip.
Figure 32B:
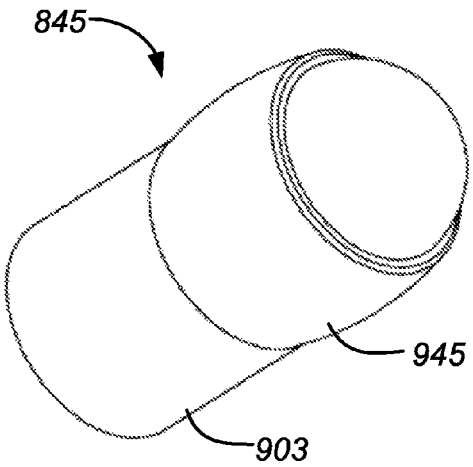
Figure 32C:
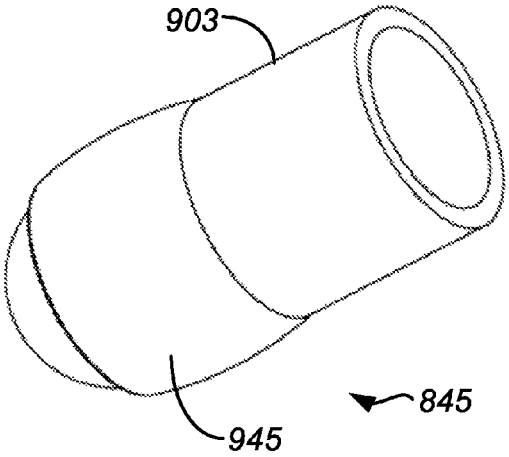

As illustrated in FIGS. 26-28, some embodiments of the interchangeable tip adapter assemblies comprise; a base 903 having a connection mechanism for insertion into the proximal end of a cartridge 740 or alternate tip adapter 803, 804, a fluid channel, through-hole, or outlet means (i.e.: 919) in fluid communication with the proximal end of the dispensing tip outlet and the distal end of the interchangeable tip applicator connection mechanism as illustrated in FIGS. 27A-C, and an optional external thread 806 (FIG. 19) for receiving a protective cap 780, comprising a first end 781, tapered outside diameter 783 and second (open) end 782, illustrated in FIG. 25.

Figure 35:
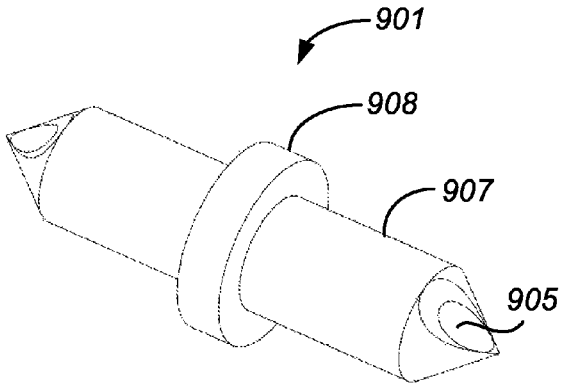
FIG. 35 is a detail isometric view of a special spike for special tip attachments, such as a fine-fiber bristle applicator brush as shown in FIG. 34.

In yet other embodiments, the alternate tip applicator assembly comprises; a base having a connection mechanism for insertion into the proximal end of a cartridge, a longitudinal through-hole in fluid communication with the proximal end of the dispensing tip outlet 902, 906 and the distal end of the tip applicator connection mechanism, wherein said tip applicator is capable of receiving a spike 901 to hold brush fibers in place and allow the flowable materials to pass through the hole 905 therein, as illustrated in FIGS. 34 and 35.

In some embodiments, the spike comprises; a base having a distal cylindrical extension 907 with a connection mechanism for insertion into the proximal end of the brush housing tip adapter 902, a proximal extension with a sized hole 905 therein for receiving the connection mechanism of other interchangeable tips i.e.: 904, and having an optional fluid channel or through-hole, longitudinally therethrough, in fluid communication with the end of the distal extension of the tip holder, as illustrated in FIG. 35.

In some embodiments, the tip adapter 800 is capable of holding other types of brush tips comprising; a mascara brush (not shown), a fine bristle brush 960, a broad bristle brush (not shown), a foundation brush (not shown), a fine comb (not shown), a mustache comb (not shown), and an eyebrow brush (not shown).

Figure 20B:
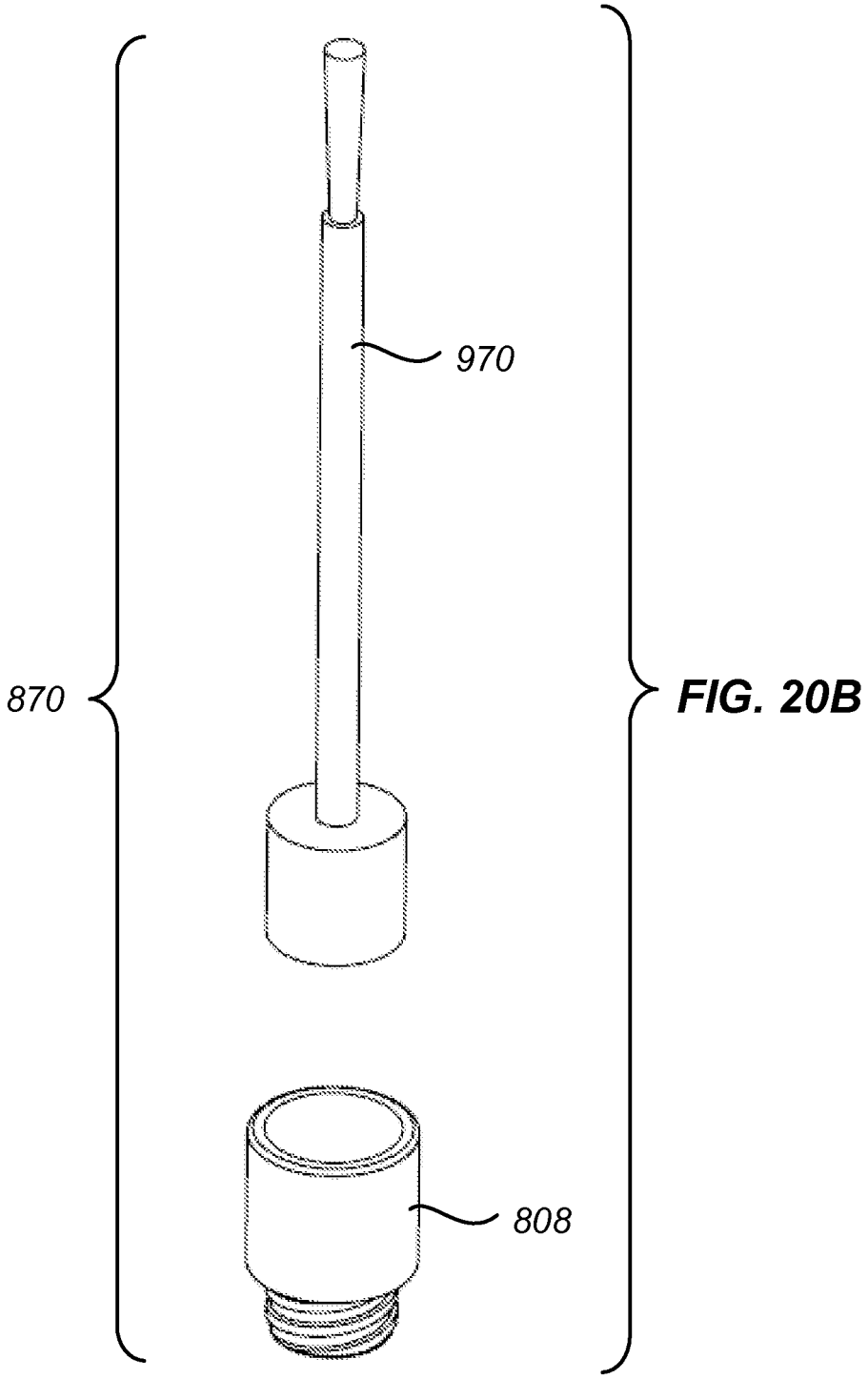
FIG. 20B is an exploded view of an alternative tip holder assembly with a long, fine brush.

In some embodiments, the tip adapter 808, 850 are capable of holding other types of brush tips comprising for example; a fine bristle brush 970, or a broad brush 965 as demonstrated in FIG. 20*b* or 33C In some embodiments, the connection mechanism between the cartridge, the interchangeable tip applicator, alternate tip adapter or special tip adapter comprises; a press-fit connection, a compression fitting 904, a tapered fitting 904, a threaded connection (not shown), a bayoneted connection (not shown), or a snap fitting (not shown). Some embodiments of the various interchangeable tip applicator assemblies for the pen dispenser device may comprise; a felt tip 925, 825, a foam tip 910, 810, a cotton tip (not shown), a spray tip applicator (not shown), a shaped polymer touch-up tip applicator 915, 815, a captured roller ball 945, 845, a hair color dye comb 930, 830, 840, a mustache brush 935, 835, or a long fine brush 970, as illustrated in FIGS. 20B, and 26-33.

Figure 23:
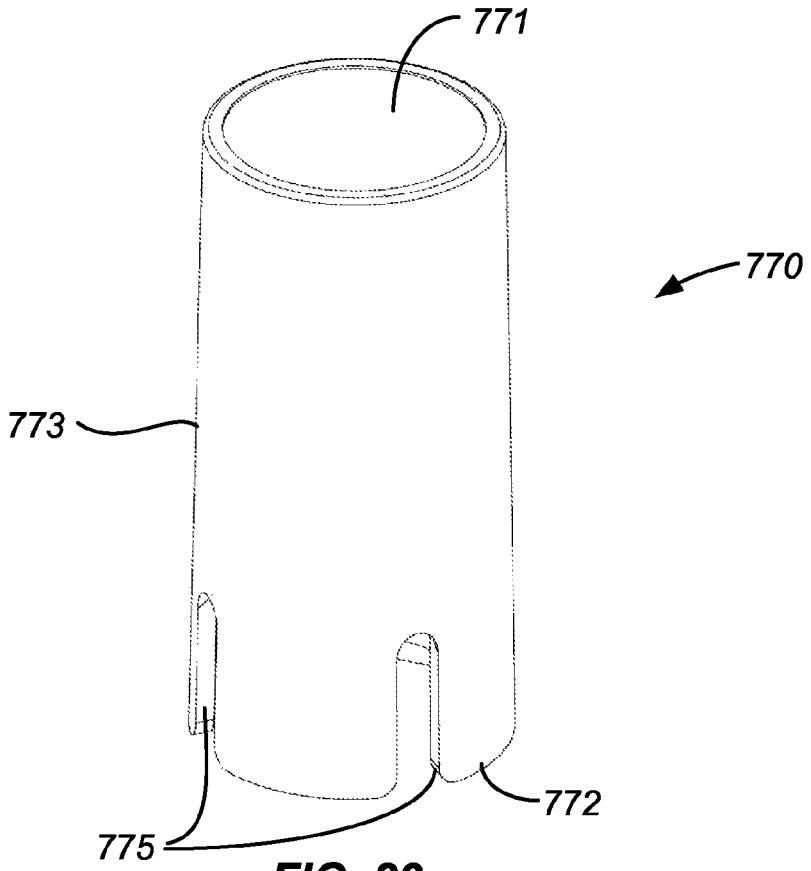
FIGS. 23-24 are isometric views of the slotted end cap.
Figure 24:
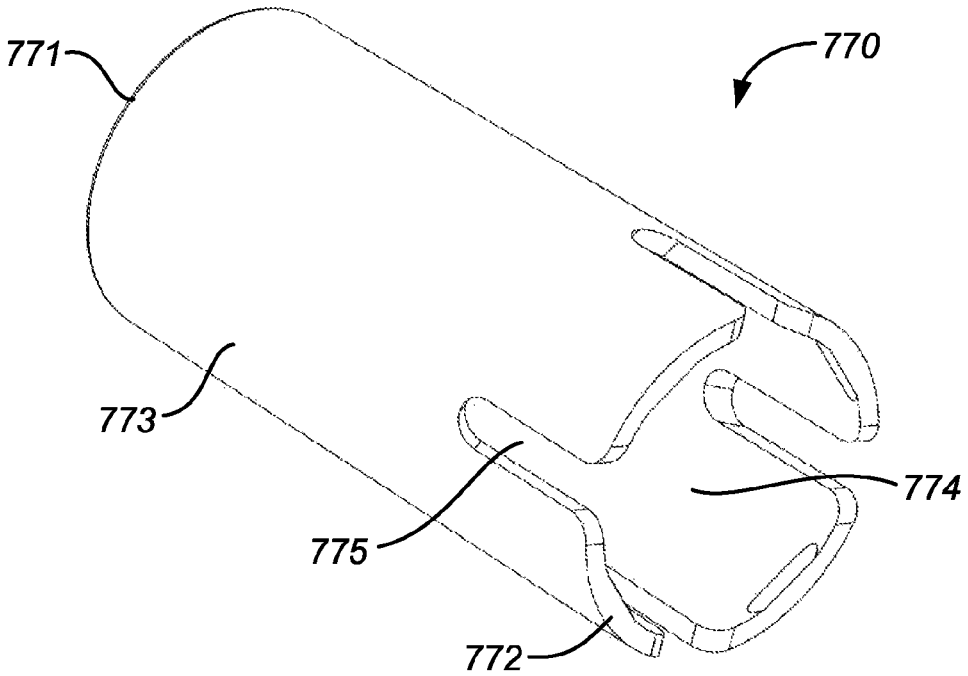

In some embodiments, the protective sealing cap 770 for the universal cartridge or interchangeable tip applicator assembly comprises; an outside diameter 773, a proximally close-ended cylinder 771 with an open distal end 772 with inside diameter 774 sized to fit snugly over the proximal end of said cartridges 700 and loosely covering any one of said interchangeable tip applicators. In other embodiments, as illustrated in FIGS. 23 and 24 the protective sealing cap optionally comprises side wall slots 775 to align with the proximal winged cap 730 of the cartridge.

In still other embodiments, the protective sealing cap 770, 780 optionally comprises an internal fluid channel spike (not shown) to seal a through-hole 919 of a tip applicator (e.g.: 915) comprising a first end 916, an outside diameter 918 and a second end 917, as illustrated in FIG. 27C.

And in still other embodiments, the protective sealing cap 780 optionally comprises a threaded distal connection 785 for attachment to a mating threaded connection 806 on an interchangeable tip applicator assembly or tip adapter as illustrated in FIG. 25. Additionally, any one of the protective sealing caps optionally comprises a sealing ring 786 to create an air-tight chamber within the cap when applied to said cartridges or tip applicator assemblies to prevent premature curing or drying of a flowable material in the cartridge or applicator assembly.

In some embodiments, the flowable material comprises nail polish, paint, ink, gel, hydrogel, lip gloss, varnish, solvents, hair color dye, perfume, cologne, paste, cosmetics, glues, lubricants, nutraceuticals, moisturizers and medicaments. In some embodiments, the flowable materials contain solvents to prevent said materials from curing prematurely or when exposed to air for brief periods. In some embodiments, the flowable materials do not contain solvents to prevent said materials from curing prematurely or when exposed to air for brief periods.

As noted previously, in some embodiments of the pen dispenser the ratchet rod advances with each press of the activator button, penetrating the distal seal of the universal cartridge, applying pressure to the piston, pushing the flowable material from said cartridge into the through-hole, exit hole, fluid channel or outlet means of the attached interchangeable tip applicator or tip adapter. However, in other embodiments it is desirable to stop applying pressure to the piston, thus preserving the contents in the cartridge or applicator assembly for later use. In still other embodiments, it may not be desirable to use the ratchet rod or compression spring at all, such as when the pen dispenser is used in a manual mode; for example to apply a powder, or other non-flowable material from a different container with one of the applicator tip assemblies for non-flowable materials. When so desired, the engaged pen dispenser barrel key 400 is twisted in a counter-clockwise rotation, (typically 90°), causing the ratchet rod 200 to synchronously de-rotate until the splined teeth of the ratchet rod 225 disengage from the activator button ratchet tooth leaf spring 630 from the spline teeth and move it to a smooth edge of the ratchet rod 230. Due to the low-spring-rate of the compression spring, there is inadequate pressure on the piston 760 to overcome the pressure in a cartridge, thus stopping the flow of any remaining materials from the cartridge to an attached tip applicator. Or in the case of manual mode applications, there is no spring force to apply any pressure to the adapter tip assembly.

In some embodiments of the device, each cartridge is intended for 1-time use. In some embodiments of the device, each cartridge is intended for multiple uses. In some embodiments of the device, the alternate tip adapter is intended for 1-time use. In some embodiments of the device, the alternate tip adapter is intended for multiple uses.

FIGS. 2, 3 and 34 comprise one possible combination illustrating an alternative pen dispenser for dispensing non-flowable material having a pen body sub-assembly 20 comprising; a posterior jacket 100 having an proximal button housing 130, a button carriage 300, an activator button 600, an anterior jacket 500 having a proximal button housing 530, and a barrel key 400, capable of holding cartridges 700 and/or alternate tip adapters 800, 808, 850, 902 with various combinations of tip adapter assemblies (previously described), in the barrel key inside diameter 435, within the anterior jacket housing, and an protective tip cap 770, 780, wherein said posterior jacket 100 having said proximal button housing 130 internally accepts and mates with said button carriage 300, aligning with, and engaging the internal capture features 120 and 140, of the posterior jacket and button carriage 320, 335, 340. The barrel key distal detents 425 on said barrel key 400 engage a capturing groove 355 in the anterior surface 310 of said button carriage 300, to align the two components. The anterior jacket 500 having a proximal button housing 530, with internal button carriage alignment holes 525 and capture rails 540, aligns with, slides over, and simultaneously captures said barrel key 400, alignment slots 445, 545, the button carriage 300, the button carriage alignment pins 325, and outer diametral capture features 135, 125, 150 of the posterior jacket 100, aligning with the proximal button housing 130 forming an assembled button housing 130/530, wherein said activator button 600 is inserted, and is captured in the button carriage pivot rockers 345, the button notch 350, and said assembled button housing.

In this embodiment, certain components may either be eliminated from the assembly during manufacture, or simply disengaged as previously described. More specifically, the ratchet rod 200 and ratchet rod compression spring 250, may be either removed from the assembly during manufacture to reduce costs, or simply not engaged by the end-user, as previously described, thus creating a "manual mode" dispenser which is only capable of dispensing non-flowable material (from an alternate source), using any one of the interchangeable tip applicators made for such applications.

For the sake of clarity, it should be reiterated that the universal cartridges may be easily converted to an alternate interchangeable tip adapter by simply removing the piston and air-tight cartridge seal, thus creating the equivalent of an alternate tip adapter, and equally capable of receiving a myriad of available interchangeable tip applicators. The reader should also understand that in this application, the terms cartridge 700 and tip adapter 800, 808, 850 are used interchangeably. In addition, the reader should understand that a tip applicator assembly (i.e.: 830, 835, 840, 845, 860, 965, 970) can be assembled with either a cartridge 700, or tip adapter 800, as a component of the assembly, or in some cases, independently.

In some embodiments of the pen dispenser, i.e.: 15, the interchangeable tip applicator assembly for non-flowable material (e.g.: 830, 835, 850, 860) is inserted though the anterior opening 520 of the anterior jacket 500 and into the barrel key inside diameter 435, engaging the outside diameter threads 806 of the tip adapter with the inside diameter threads 430 of the barrel key.

In some embodiments, the interchangeable tip applicator assembly for non-flowable material comprises; a tubular body (cartridge 700, or tip adapters 800 and 850) having a proximal and distal end, a hollow interior cylinder with a distal opening, an exterior cylinder with a distal portion, a threaded proximal portion (and optionally, in the case of a universal cartridge, a winged cap portion proximal to the threaded portion), wherein the distal portion comprises a base for insertion into the anterior end of the pen dispenser, a proximal opening 803 having a connection mechanism for receiving the mating connection 903 of at least one interchangeable tip applicator (e.g.: 930, 935, 960, 970) or tip attachment 902.

In some embodiments, the interchangeable tip applicator comprises; a base having a connection mechanism 903 for insertion into the proximal end of said interchangeable tip adapter 700 or 800, an optional through-hole, or outlet means therethrough (e.g.: 809), in fluid communication with the proximal end of the dispensing tip outlet (e.g.: 919) and the distal end of the interchangeable tip applicator connection mechanism, and may also comprise an optional external thread 806 for receiving a protective cap.

As illustrated in FIG. 34, some embodiments, the interchangeable tip applicator 902 alternately comprises; a base having a connection mechanism for insertion into the proximal end of said interchangeable tip applicator assembly, a optional longitudinal through-hole 906, in fluid communication with the proximal end of the dispensing tip outlet and the distal end of the tip applicator connection mechanism, wherein said tip applicator is capable of receiving a tip adapter or tip holder/spike 901 for accepting other interchangeable tips with different connectors 904, such as fine brush tips 960, insertable in the through-hole 905 therein.

In some embodiments a tip adapter 902 comprises; a cylindrical body having a proximal and distal end, a proximal opening 906 having a connection mechanism for receiving a spike 901 and, (an optional threaded exterior distal to said proximal tip for receiving a protective cap—not shown), an abutting shoulder distal to the rounded proximal tip and optional threads, and a smooth distal exterior cylinder portion.

In some embodiments, the spike 901 comprises; a cylindrical body having a distal connection mechanism 907, a shoulder stop 908, a proximal cylindrical body and countersink hole 905 with a through-hole, for receiving special interchangeable tip applicators where flowable material will pass through, such as illustrated in FIG. 35.

As illustrated in FIGS. 33A C, some embodiments of the interchangeable tip applicators for non-flowable material or tip adapters 800, 850 comprise a base 805 having a hole 950 for insertion of the various tip applicators at the proximal end of the cartridge. In some embodiments of the interchangeable tip applicators for non-flowable material, the connection mechanism comprises a press-fit connection, a tapered fitting, a compression fitting, a bayonet connection, a threaded connection, or snap fitting.

In some embodiments of the interchangeable tip applicator assembly, the externally distal threaded portion may thread directly into said barrel key such as adapter/holder 850 shown if FIG. 33.

In some embodiments of the device, the interchangeable tip applicator assemblies for non-flowable material comprise; any one of a multitude of available interchangeable tip applicators for non-flowable material comprising; a felt tip 925, a foam tip 910, a cotton tip (not shown), an eyelash brush 935, a fine comb (not shown), a mustache comb 935, a hair comb 930, a mascara brush (not shown), a fine bristle brush 960, a broad make-up brush 965, and a foundation brush (not shown).

In some embodiments of the device, the non-flowable materials comprise; mascara, foundation, powder makeup materials, viscous glues and creams.

Provided herein is a cartridge system comprising; at least one interchangeable tip applicator having an outlet means, an optional protective cap, an optionally disposable capsular containment cartridge body having a proximal end and a distal end, wherein, said proximal end having a connection mechanism for an interchangeable tip applicator; said distal end having a ram piston 760 comprising a compression ram surface 762, an open end 764, an inside diameter 766, and an outside diameter 765 with a shoulder diameter 761 and plastic or polymer seal, the capsular body of the cartridge system containing a flowable material; wherein the disposable plastic capsular unit inserts into a pen dispenser, and wherein a ratchet rod pushes through the plastic or polymer seal, contacting the ram piston compression ram surface 762, and orifice 769. FIGS. 18, 21, 22, 26A, 27A, 28A, 31A, 32A and 34 are representative examples of said cartridge system.

In some embodiments of the cartridge system, the ram piston is pushed into the disposable capsular containment cartridge body, forcing said flowable material through the interchangeable tip applicator outlet means of the interchangeable tip applicator. In some embodiments, the cartridge system interchangeable tip applicator contains a central through-hole, an exit hole, multiple holes, a fluid channel, or other outlet means having fluid communication with the proximal dispensing tip and the interior of the disposable containment cartridge whereby the substance being dispensed flows out of the capsule of the cartridge body and through the tip applicator outlet means.

In some embodiments, the at least one interchangeable tip applicator comprises; a connection mechanism adaptable for insertion into the proximal end of a disposable plastic capsular unit of the cartridge, having a through-hole or outlet means in fluid communication with the dispensing tip outlet means and said disposable capsular unit, and any one of a multitude of applicator dispensing tips comprising; a fine comb, a mustache comb, an eyebrow brush, an eyelash brush, a hair comb, a an eye liner tip, a fine bristle brush, a felt tip, a cotton tip, a foam tip, a sprayer tip applicator, a shaped polymer tip applicator, or a captured roller ball.

In some embodiments, the connection mechanism between the tip applicator and the cartridge body comprises; a tapered fitting, a compression fitting, a threaded connection, a bayonet connection, or a snap fitting.

Method of Use

Provided herein is a method of using a pen dispenser wherein flowable material is applied from a cartridge filled with the flowable material to be dispensed, and capable of accepting a multitude of interchangeable tip applicators. In some embodiments of the method of using the pen dispenser, the device may be used in a manual mode wherein non-flowable material is applied with tip applicators for non-flowable material adapted for insertion into tip applicators assemblies for non-flowable materials, optionally having tip adapters for still other, non-standard tip applicators. In the manual mode, the ratchet rod and compression spring are not engaged and have no function. In some embodiments of this device, the inventors have provided a method of using a cartridge system, wherein the cartridges may be designated for 1-time use or multiple uses. In some embodiments of this device, the inventors have provided a method of using a manual tip applicator assembly system, wherein the tip applicator assemblies or individual tip adapters may be designated for 1-time use or multiple uses.

Method of Manufacture

Provided herein is a method of manufacturing a pen dispenser, wherein components are toleranced for rapid manual assembly. In some embodiments, components are toleranced for rapid automated assembly.

In some embodiments, moving components are minimized or eliminated to reduce cost, simplify assembly and to simplify use. In some embodiments, components with similar function are easily interchangeable during assembly and use.

In some embodiments, connection mechanisms are of the same configuration for all interchangeable components. In some embodiments, components having similar function have similar connection mechanisms. In some embodiments, different component groups have different connection mechanisms to prevent incorrect assembly.

Composition—(Flowable Materials)—

Provided herein is a composition of flowable materials for use in a pen dispenser, wherein the flowable material can be a liquid or a gel in viscosity.

In some embodiments, the composition of flowable material is a cosmetic. In some embodiments, the composition of flowable material comprises; a medicament, nail polish lip gloss, paint, hair color dye, cosmetic or fingernail glue, a lubricant, a solvent, an ink, a gel, a hydrogel, a varnish, a perfume, a cologne a paste, a nutraceutical, or a moisturizer.

Composition—(Non-Flowable Material):

Provided herein is a composition of non-flowable materials for use in a pen dispenser, wherein the material is a cosmetic powder. In some embodiments, the inventors have provided compositions of non-flowable material for use with the pen dispenser, wherein, the material can be solid, cream or a powder. In some embodiments, the composition of non-flowable materials comprises, mascara, a concealer, a foundation, a powder, a medicament, or a viscous paste.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A cartridge system comprising:

a cartridge comprising a cartridge body comprising;

an open proximal end that directly connects to a separable interchangeable tip applicator, a distal end that is open, a separable piston at the distal end, a separate distal seal covering the open distal end behind the piston, a threaded exterior portion;

a flowable material contained in said cartridge body; and the interchangeable tip applicator adapted for insertion into the cartridge body, wherein said cartridge system is threadably insertable into a pen dispenser.

2. The cartridge system of claim 1, wherein said open proximal end comprises a first portion of a connection mechanism for connecting to said interchangeable tip applicator.

3. The cartridge system of claim 2, wherein said connection mechanism comprises:

a tapered connection, a threaded connection, or a press-fit connection.

4. The cartridge system of claim 1, wherein said interchangeable tip applicator comprises:

an interchangeable tip adapter; and an interchangeable applicator tip.

5. The cartridge system of claim 1, wherein said flowable material comprises:

nail polish, hair dye color, lip gloss, perfume, cologne, fingernail glue, cosmetic glue, hydrogel nail paint, hair dye color, or nail varnish.

6. The cartridge system of claim 4 wherein the tip adapter comprises a tubular body comprising;

a tip adapter proximal end configured to receive the applicator tip, a tip adapter distal end, a hollow interior portion with a distal opening, a second portion of the connection mechanism for insertion into said open proximal end of said cartridge body, and a threaded exterior portion for receiving a protective cap.

7. The cartridge system of claim 4 wherein the applicator tip comprises:

a fine bristle brush, a felt tip, a foam tip, a cotton tip, a spray tip applicator, a shaped polymer tip applicator, a captured roller ball, a hair dye comb, or a mustache brush.

8. The cartridge system of claim 4 wherein the applicator tip comprises:

a spike configured for receiving alternate applicator tips, or a fine bristle brush.

9. The cartridge system of claim 6, wherein the protective cap comprises:

a proximally closed end and an open distal end, said distal end comprising internal threads configured to match said threaded exterior portion of said tip adapter and an interior configured to cover and protect said applicator tip.

10. The cartridge system of claim 1, wherein said cartridge body further comprises:

a winged portion comprising a plurality of wings.

11. The cartridge system of claim 10, comprising a protective cap configured to mate with said winged portion of said cartridge body to cover and protect said interchangeable tip applicator, wherein said protective cap comprises:

a proximally closed-end with an open distal end sized to fit over said winged portion of said cartridge body with a plurality of wing slots fitting around said cartridge body wings and said proximally closed end covering said interchangeable tip applicator.

12. The cartridge system of claim 11, wherein the protective cap comprises:

an interior seal configured to seal the interior of the protective cap and to protect the applicator tip from the effects of ambient air when not in use; and an internal fluid channel spike emanating from the proximally closed end of the cap.

13. An interchangeable tip applicator assembly for dispensing non-flowable material, the tip applicator assembly comprising a tip adapter that comprises:

a tubular body comprising:

a proximal end, a distal end, an interior with a first opening at the distal end, a second opening at the proximal end having a first portion of a connection mechanism to receive an applicator tip, and an exterior comprising a threaded connection for insertion into a pen dispenser; and the applicator tip comprising a second portion of the connection mechanism to mate with the first portion of the connection mechanism on said tip adapter.

14. The interchangeable tip applicator assembly of claim 13, wherein said connection mechanism for receiving an applicator tip comprises:

a press-fit connection, a taper connection, a bayoneted connection, a snap-fit connection, or a threaded connection.

15. The applicator tip assembly of claim 13, comprising:

a foundation brush, an eyebrow brush, an eyelash brush, a hair comb, a mascara brush, a fine comb, a mustache comb, a fine bristle brush, a felt tip, a cotton tip, a shaped polymer tip applicator, a paint brush, or a sponge tip.

16. A pen dispenser comprising:

a cartridge system comprising;

a cartridge comprising a cartridge body comprising;

an open proximal end that connects to a separable interchangeable tip applicator, a distal end that is open, a separable piston at the distal end, a separate distal seal covering the open distal end behind the piston, a threaded exterior portion;

a flowable material contained in said cartridge body; and the interchangeable tip applicator adapted for insertion into the cartridge body; and a pen body comprising a button-activated ratchet rod that is arranged to push through said distal seal and contact said piston, and a barrel key, wherein the cartridge system is threadably insertable into the barrel key of the pen body.

17. The pen dispenser of claim 16 wherein the cartridge system is configured to fit within the pen body; and wherein the pen body further comprises a posterior jacket with capture features, a ratchet rod compression spring, a button carriage, an anterior jacket, and an activator button, wherein said posterior jacket internally accepts said ratchet rod compression spring, wherein said ratchet rod compresses said ratchet rod compression spring, wherein said button carriage slides over and captures a distal end of said ratchet rod, thereby compressively retaining said ratchet rod compression spring, wherein said barrel key slides over a protruding end of said ratchet rod, wherein distal detents on said barrel key engage a capturing groove in an anterior surface of said button carriage, wherein said anterior jacket aligns with, slides over, and simultaneously captures said barrel key, said button carriage, and capture features of said posterior jacket, forming an assembled button housing, wherein said activator button inserts and is captured within said assembled button housing, and wherein said activator button aligns with a non-splined side of said ratchet rod within said pen body.

18. The pen dispenser of claim 17 wherein the ratchet rod has splined teeth on only a splined side of the ratchet rod.

19. The pen dispenser of claim 18, wherein said barrel key comprises a hollow tubular structure comprising an open proximal end with a connection mechanism for receiving one or more interchangeable components through an anterior opening of the anterior jacket, and a closed distal end having an opening therethrough for receiving the protruding end of the ratchet rod at a fixed rotation, wherein the splined side of the ratchet rod can enter the opening in only one orientation.

20. The pen dispenser of claim 19, wherein the interchangeable components comprise at least one of:

the cartridge system comprising a flowable material and the interchangeable tip applicator;

a tip adapter for applying non flowable materials; and a protective cap.

* * * * *